US009782311B2

(12) United States Patent
Lafleche et al.

(10) Patent No.: US 9,782,311 B2
(45) Date of Patent: Oct. 10, 2017

(54) PATIENT/INVALID SUPPORT WITH PRESSURE REDUCING SYSTEM

(71) Applicant: Stryker Corporation, Kalamazoo, MI (US)

(72) Inventors: Patrick Lafleche, Kalamazoo, MI (US); Tyler Scott Wright, Kalamazoo, MI (US); Parikshit Atre, Kalamazoo, MI (US); Prachi Jain Slominski, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 557 days.

(21) Appl. No.: 13/743,758

(22) Filed: Jan. 17, 2013

(65) Prior Publication Data

US 2014/0068869 A1 Mar. 13, 2014

Related U.S. Application Data

(60) Provisional application No. 61/587,412, filed on Jan. 17, 2012, provisional application No. 61/706,952, filed on Sep. 28, 2012.

(51) Int. Cl.
*A61G 7/057* (2006.01)

(52) U.S. Cl.
CPC ..... *A61G 7/057* (2013.01); *A61G 7/05715* (2013.01); *A61G 7/05738* (2013.01); *A61G 7/05792* (2016.11)

(58) Field of Classification Search
CPC ..... A47C 27/08–27/088; A61G 7/05707–7/05776; A61G 2007/05784–2007/05792
USPC ..... 5/724, 423, 726, 727, 740
See application file for complete search history.

(56) References Cited

U.S. PATENT DOCUMENTS 3,486,177 A * 12/1969 Marshack ..... A61G 7/057 219/212
4,901,383 A * 2/1990 Yang ..... A47C 27/085 403/205
4,947,500 A * 8/1990 Seiler ..... A47C 27/081 5/706
5,035,014 A * 7/1991 Blanchard ..... 5/732
5,887,304 A * 3/1999 von der Heyde .... A47C 21/044 5/423
6,243,894 B1 * 6/2001 Kosumsuppamala et al. ... 5/732
6,516,483 B1 * 2/2003 VanSteenburg .... A61G 7/05715 5/727

(Continued)

FOREIGN PATENT DOCUMENTS

KR 20-0435149 1/2007
WO 2010078039 A2 7/2010

OTHER PUBLICATIONS

PCT International Search Report in connection with Application No. PCT/US2013/021892, filed Jan. 17, 2013.

(Continued)

*Primary Examiner* — Peter M Cuomo
*Assistant Examiner* — Ifeolu Adeboyejo
(74) *Attorney, Agent, or Firm* — Warner Norcross & Judd LLP

(57) ABSTRACT

A patient support includes a plurality of stacked layers of cushioning material, at least two of the layers comprising foam, each of the at least two layers having a different firmness, and at least one of the layers comprising a gel-based cushioning layer.

17 Claims, 33 Drawing Sheets

(56) References Cited

U.S. PATENT DOCUMENTS

| | | | | |
|---|---|---|---|---|
| 7,240,386 | B1 | 7/2007 | McKay et al. | |
| 7,480,953 | B2 | 1/2009 | Romano et al. | |
| 7,945,979 | B1 * | 5/2011 | Lin | A47C 21/044 5/423 |
| 8,347,436 | B2 * | 1/2013 | Flick et al. | 5/732 |
| 8,601,620 | B2 | 12/2013 | Romano et al. | |
| 8,607,387 | B2 | 12/2013 | Flick et al. | |
| 8,832,883 | B2 * | 9/2014 | Schwirian | A61B 5/1115 5/706 |
| 2003/0150060 | A1 * | 8/2003 | Huang | A47C 21/044 5/726 |
| 2007/0113352 | A1 * | 5/2007 | Poulos | A61G 7/05776 5/727 |
| 2008/0115288 | A1 * | 5/2008 | Poulos | 5/727 |
| 2010/0146709 | A1 * | 6/2010 | Lafleche | A61G 7/05715 5/713 |
| 2010/0175196 | A1 * | 7/2010 | Lafleche et al. | 5/707 |
| 2011/0010865 | A1 * | 1/2011 | Flick | A47C 7/021 5/690 |
| 2011/0289691 | A1 | 12/2011 | Lafleche et al. | |
| 2013/0067662 | A1 * | 3/2013 | Jusiak et al. | 5/724 |
| 2013/0081208 | A1 * | 4/2013 | Dyevich et al. | 5/727 |

OTHER PUBLICATIONS

PCT International Written Opinion in connection with Application No. PCT/US2013/021892, filed Jan. 17, 2013.

Supplemental European Search Report and Annex, dated Jun. 25, 2015, for European patent application 13736389.9, corresponding to U.S. Appl. No. 13/743,758.

Supplemental European Written Opinion, dated Jun. 25, 2015, for European patent application 13738389.9, corresponding to U.S. Appl. No. 13/743,758.

* cited by examiner

PATIENT/INVALID SUPPORT WITH PRESSURE REDUCING SYSTEM

The present application claims the benefit of provisional application U.S. Patent Application No. 61/587,412 filed Jan. 17, 2012, PATIENT/INVALID SUPPORT WITH PRESSURE REDUCING SYSTEM (STR03A-P390) and U.S. Patent Application No. 61/706,952 filed Sep. 28, 2012, PATIENT/INVALID SUPPORT WITH PRESSURE REDUCING SYSTEM (STR03A-P390A), which are hereby incorporated by reference herein in their entireties. This application is related to provisional application U.S. Patent Application No. 61/537,325, filed Sep. 21, 2011 (STR03A P377), which is hereby incorporated by reference herein in its entirety.

TECHNICAL FIELD AND BACKGROUND OF THE INVENTION

The present invention relates to a support and, more particularly, a patient or invalid support, such as a mattress, that is adapted for use on a patient bed used in a hospital or other patient care facilities, including long term care facilities or the like.

When patients are hospitalized or bedridden for any significant amount of time, patients can develop pressure sores or ulcers. These pressure sores or ulcers can be exacerbated by the patient's own poor circulation, such as in the case of diabetic patients, but typically form as a result of prolonged immobility, which allows the pressure exerted on the patient's skin from the mattress to decrease circulation in the patient's tissue.

To address these issues, various surfaces have been developed, each with challenges from a manufacturing and cost perspective. Some mattresses provide excellent pressure redistribution but are heavy and, therefore, may be hard to maneuver when cleaning, for example. Others are light weight but may be more complicated to manufacture, and hence costly.

Accordingly there is a need for a mattress that can offer similar or better performance than prior art mattresses but without the attendant weight issues and manufacturing complexities of current mattresses.

SUMMARY OF THE INVENTION

The present invention provides a patient support with a system of layers of varying materials that provides pressure redistribution across its patient support surface area at the interface between the patient and the patient support.

In one form of the invention, a patient support includes a plurality of stacked layers of cushioning material, which form a patient support surface. At least two of the layers comprise foam, with each of the at least two layers having a different firmness. At least one of the layers comprises a dry polymer gel-based cushioning layer.

In another form of the invention, a patient support includes a plurality of stacked layers of cushioning material, which form a patient support surface. At least two of the layers comprise gel, with each of the at least two layers having a different firmness. At least one other of the layers comprises a foam cushioning layer.

According to another form of the invention, a patient support includes a patient support surface formed from a plurality of stacked layers of foam, each of the layers having a different firmness, and at least one lower layer comprising a dry polymer gel-based cushioning layer.

In yet another form of the invention, a patient support includes a plurality of stacked layers of cushioning material, which form a patient support surface. The layer forming the intermediate or bottom cushion layer has a lower (or equal) IFD (IFD measured per ASTM D3574) than the top layer.

In any of the above supports, the stacked layers of cushioning material form a primary patient support surface. The primary patient support surface is bounded between two rails that are formed from a foam material with a greater firmness that any of the layers forming the patient support surface to thereby form a cradle around the patient support surface to reduce the risk of a patient from rolling off the patient support. Optionally, each rail may be formed from an upper rail and a lower rail, with the lower rail having a greater firmness than the upper rail, for example, to increase the comfort to the patient.

In one aspect, in any of the above supports, a cover envelopes the layers to protect the layers of cushioning material and optionally protect the layers from liquid intrusion.

In another aspect, in any of the above supports, at least one of the layers comprises a wedge, for example, at the foot end of the patient support, which has a firmness that is different than the remaining portion or portions of the layer containing the wedge, to provide a smoother transition of firmness between the different cushioning materials on the same plane.

In a further aspect, the wedge abuts the gel-based cushioning layer.

In yet another aspect, in any of the above supports, the layers of cushioning material includes an upper layer or topper, which extends across the full length and width (within the rails) of the patient support surface. For example, the upper layer may be formed from a foam with an IFD in a range of 9 to 14 (IFD measured per ASTM D3574).

In yet a further aspect, in any of the above supports, the layers of cushioning material include an intermediate layer formed from two sections of foam, with one section being at the foot end and being less firm than the other section of foam in the same layer. For example the foot end section of foam may be formed from a foam with an IFD in a range of 9 to 14. The other section of foam in the same layer may be formed from a foam with an IFD in a range of 32 to 38 (IFD measured per ASTM D3574).

Accordingly to yet another aspect, in any of the above supports, the layers of cushioning material includes a bottom layer, which consists of the foot end wedge, noted above, the gel-based cushioning layer, noted above, and a head end section of foam. For example, the foot end wedge may be formed from a foam with an IFD in a range of 12 to 18. The gel-based cushioning layer may have an IFD in a range of 29 to 35 (measured at 50% deflection of 50 sq. inch area). And the head end section of foam may be formed from a foam with an IFD in a range of 12 to 18 (IFD measured per ASTM D3574).

In any of the above gel-based cushioning layers, the gel-based cushioning layer may include a dry polymer gel layer and upper and lower sheets of non-woven material that are adhered to the gel layer on opposed respective sides, with the non-woven sheets anchoring the gel-based cushioning layer to the adjacent cushioning materials.

In a further aspect, the non-woven sheets do not cover the central portion of the gel-based cushion layer so as not to interfere with the immersion characteristics of the gel layer.

Optionally, in any of the above supports, the upper layer may be formed from foam or from a dry polymer gel.

Further, the upper layer may include a plurality of recesses that extend from its upper surface and either terminate before the lower surface or extend all the way through the layer. A second gel layer, such as an intermediate gel layer, may be provided that has a lower IFD that the top layer.

In another aspect, in any of the above supports, the gel layer may incorporate foam to vary the immersion characteristics of the gel layer. For example, the gel layer may be formed by a plurality of intersecting gel walls that form a matrix with hollow spaces or cavities formed between the walls. The spaces may extend through the entire gel layer or may be closed on one end by a gel skin layer. Foam bodies may be positioned in one or more of the spaces to reinforce the adjacent gel walls so that immersion response of the gel layer is modified to provide a more gradual immersion into the support.

In one form the gel layer includes a plurality of foam bodies. For example, each foam body may be positioned in a respective space of the gel layer. The foam bodies may be solid or hollow or have an outer surface that is different than the surfaces formed by the gel walls surrounding the respective space.

In yet another form of the invention, a patient support includes a plurality of stacked layers of cushioning material, which form a patient support surface. At least two of the layers comprise foam, with each of the at least two layers having a different firmness. At least one of the layers comprises a dry polymer gel-based cushioning layer.

Accordingly, the present invention provides a patient support that provides a variable firmness across the patient support surface to reduce high pressure points to manage pressure distribution at the patient interface, and includes a sacral region that redistributes pressure using dry polymer gel technology, and optionally buckling dry polymer gel technology.

These and other objects, advantages, purposes, and features of the invention will become more apparent from the study of the following description taken in conjunction with the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE PREFERRED EMBODIMENTS

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

Figure 1:
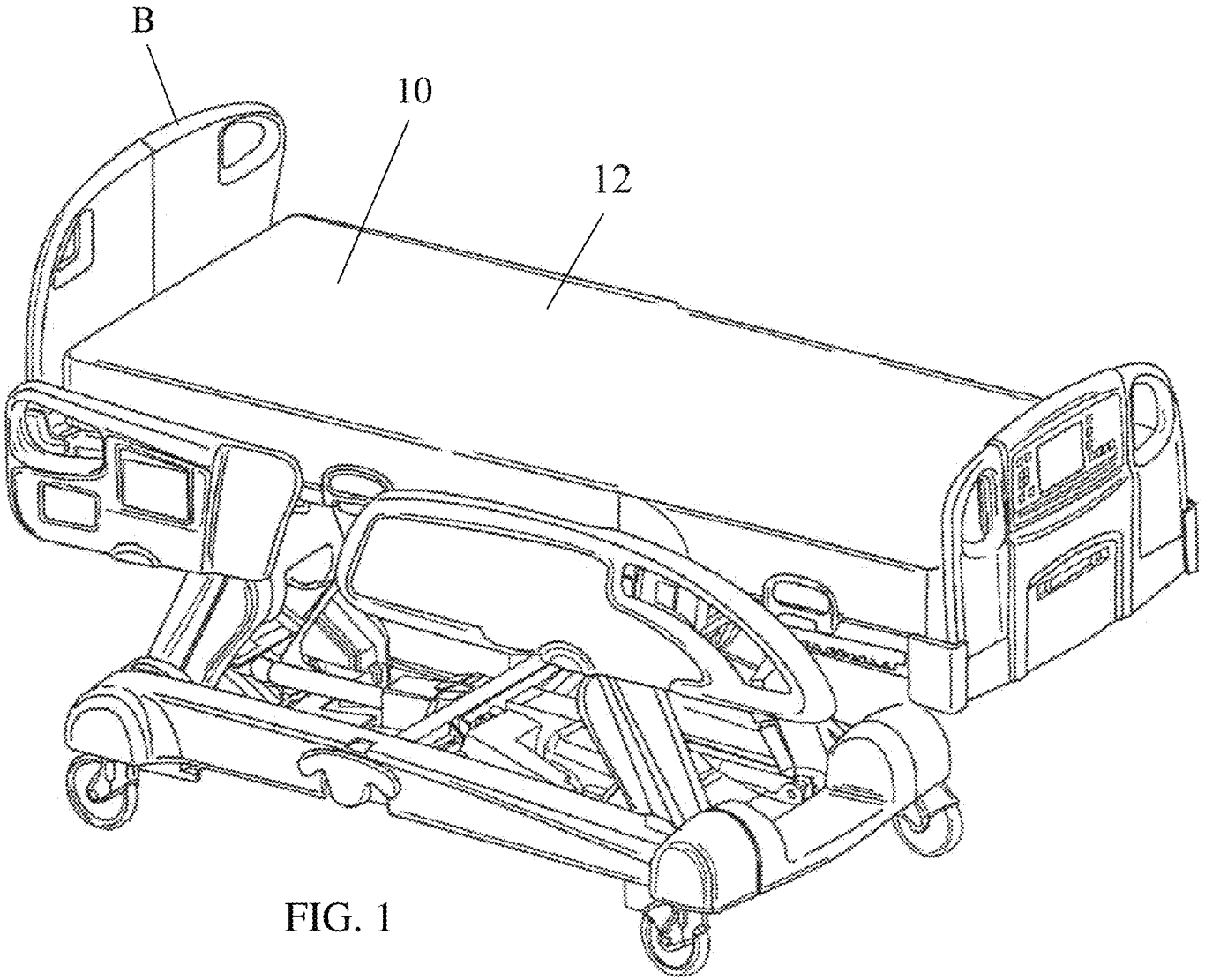
FIG. 1 is a perspective view of a patient support of the present invention supported on a bed.
Figure 2:
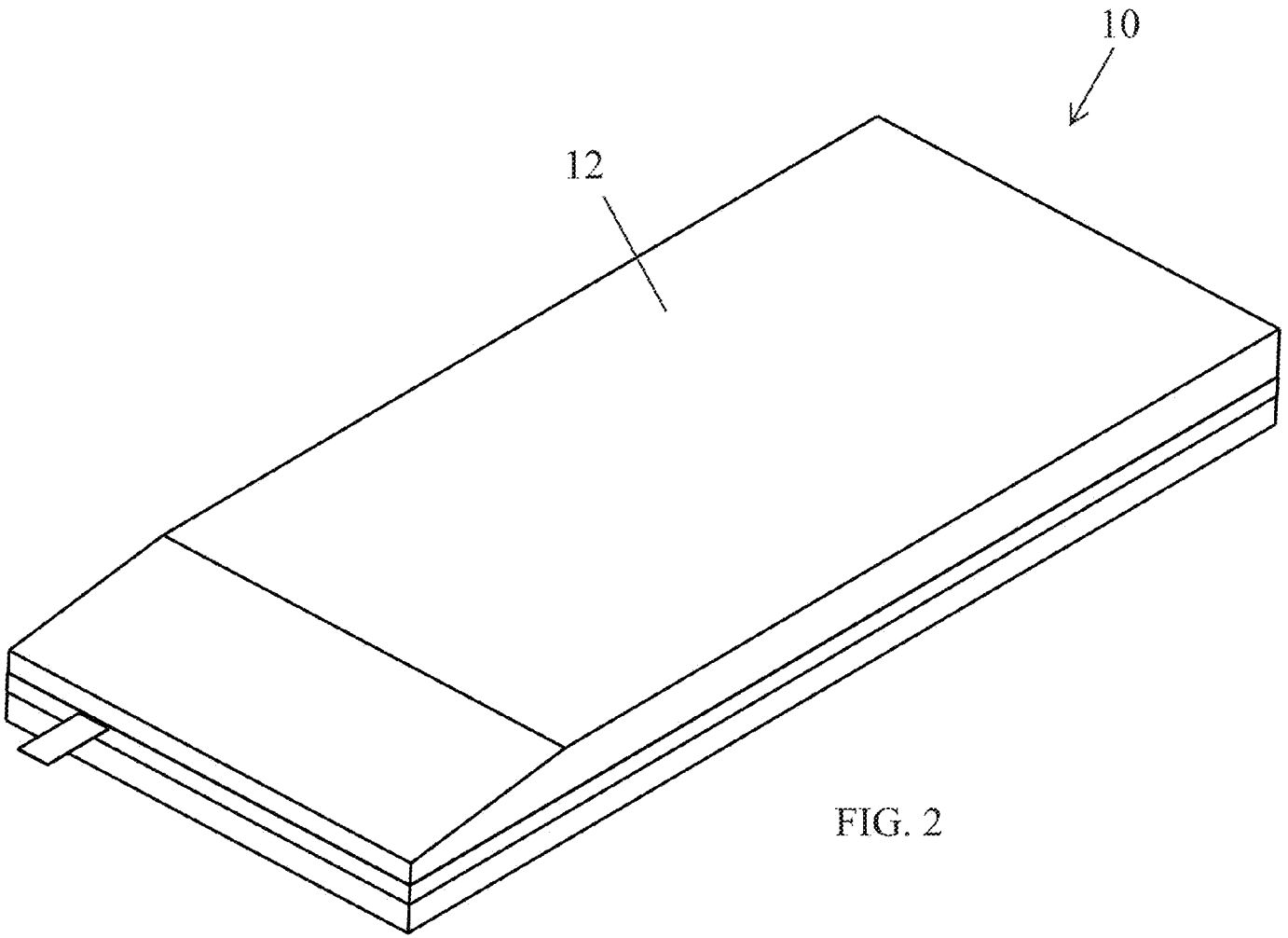
FIG. 2 is a perspective view of the patient support of FIG. 1.
Figure 3:
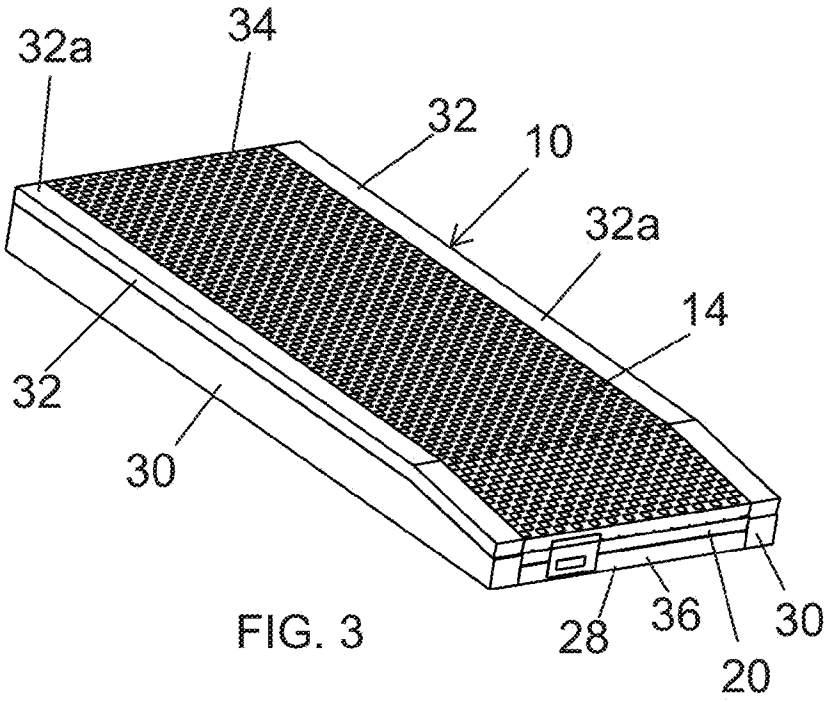
FIG. 3 is a similar view to FIG. 2 with the cover removed.
Figure 4:
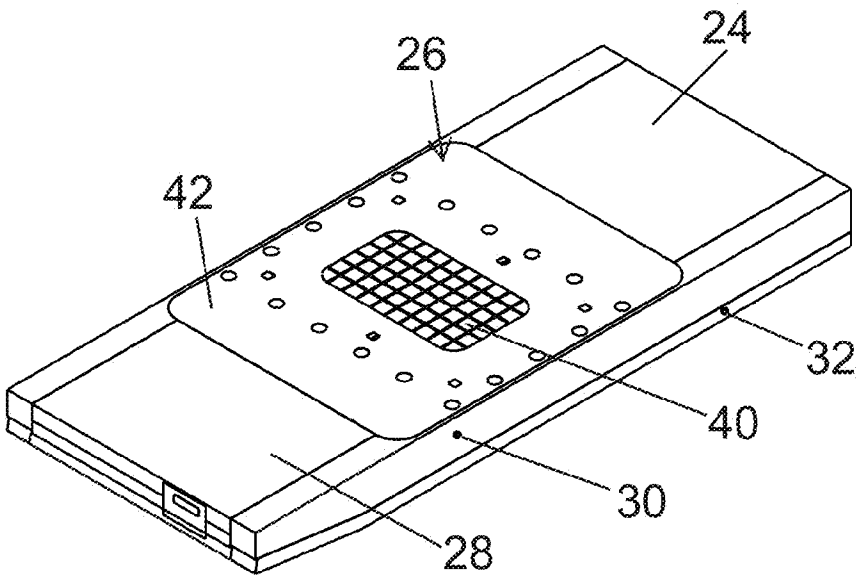
FIG. 4 is a bottom perspective view of the patient support of FIG. 3 illustrating a dry polymer gel cushioning layer assembly.

Referring to FIG. 1, the numeral 10 generally designates a patient support of the present invention. As will be more fully described below, support 10 may be configured as a mattress for a bed B, such as a hospital bed, which optionally includes a deck, headboard, footboard, and side rails as described in the referenced patents. Support 10 comprises a cover 12 and a system of layers that together provide increased comfort for the patient and further pressure redistribution to reduce the chances of the patient developing pressure sores, especially at high risk locations, such as in the patient's heels or sacrum area. For details of a suitable bed, reference in made herein to the beds described in U.S. Pat. Nos. 8,006,332; 7,690,059; 7,805,784; 7,962,981; and 7,861,334, all commonly owned by Stryker Corporation of Kalamazoo, Mich., which are herein incorporated by reference in their entireties.

In the illustrated embodiment, support 10 includes an upper layer 14 that may be formed from a sheet of foam, an intermediate layer 16 formed form two sheets or sections (18, 20) of foam, and a base or bottom layer 22 that is formed from a foam sheet or section (head end section) 24, which is at the head end of the support, a dry polymer gel-based cushioning assembly 26, which is in the sacrum region of the support, and a foam sheet or section (foot end section) 28 with a wedge shape, which is at the foot end of the support. As used herein "foam' refers to solid or structural lightweight cellular material, including open cell foam or closed cell foams. It should be understood that each of the sheets or sections may also be formed from multiple layers with similar or varying properties, and that additional layers may be interposed between each of the respective layers.

Bounding or straddling the system of layers on both sides are one or more rails 30, 32. In the illustrated embodiment, each side includes a pair of stack rails, which extend from the head end 34 of support 10 to the foot end 36 of support 10. Further, the rails are configured so that their upper surfaces 32*a* are generally coplanar with and follow the surface topology of the upper surface of the upper layer 14. For example, in the illustrated embodiment, the foot ends of lower rails 30 each have a wedge shape that is angled downwardly at approximately the same angle as the foot end section of layer 22, described more fully below.

Rails 30 and 32 are each formed from foam, with at least the base rails (30) being firmer than any of the components forming layers 14, 16, and 22 so that together they form a crib to facilitate retention of the layers and moreover form a firmer edge for support 10 to facilitate ingress and egress and also to help prevent the patient from rolling off the patient support. Rails 30 and 32 are glued together at their interface to form a composite rail. Optionally, rails 30 and 32 may also be used for line management, e.g. to contain conduits, such as tubing, which may be used to direct fluid, namely air, to an optional low air loss or cooling system.

Figure 5A:
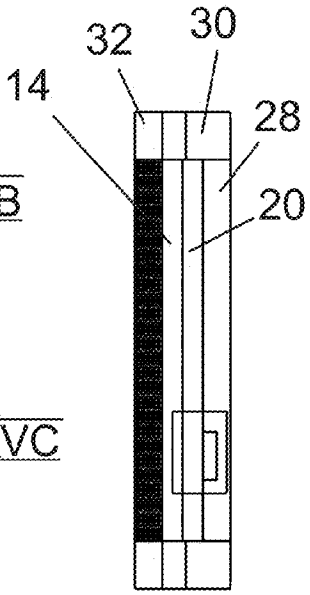
FIG. 5A is a right end view of the patient support of FIG. 5.
Figure 5:
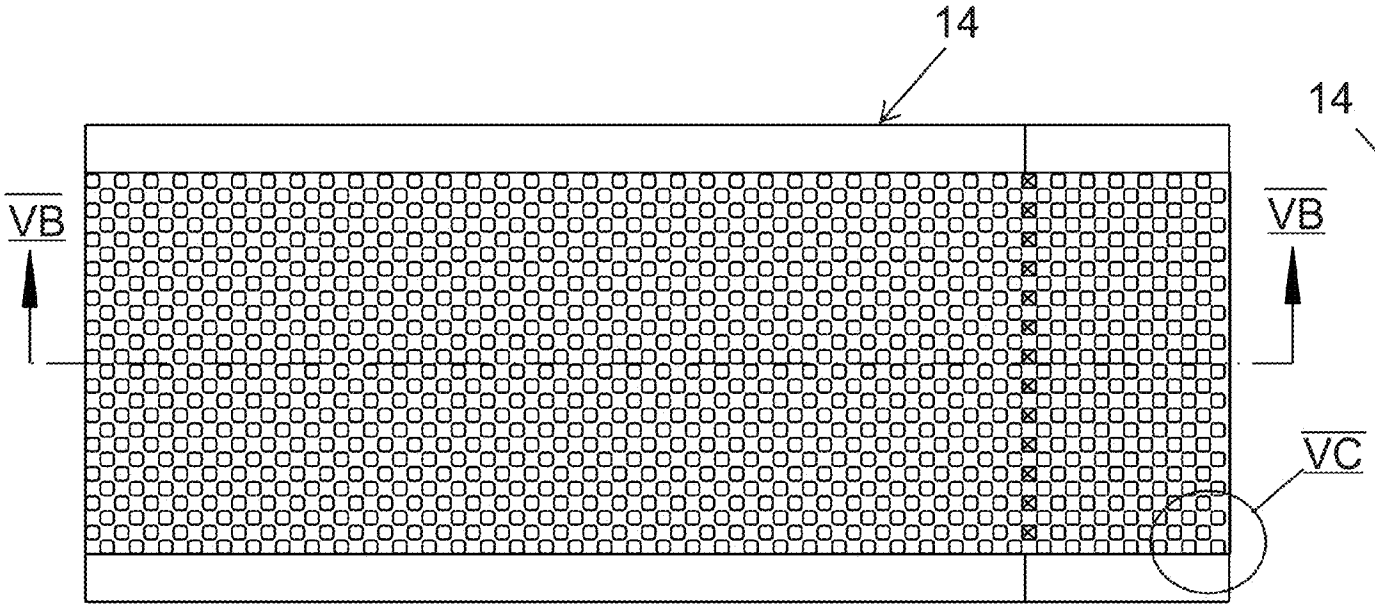
FIG. 5 is a top plan view of the patient support of FIG. 3.
Figure 6:
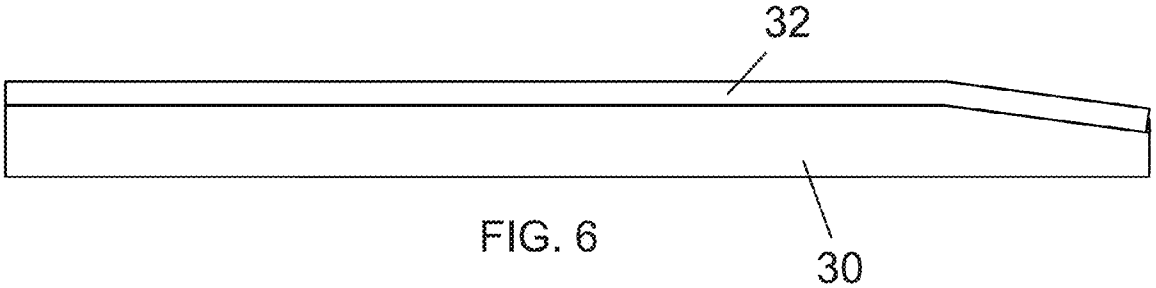
FIG. 6 is a side elevation view of the patient support of FIG. 5.
Figure 5B:
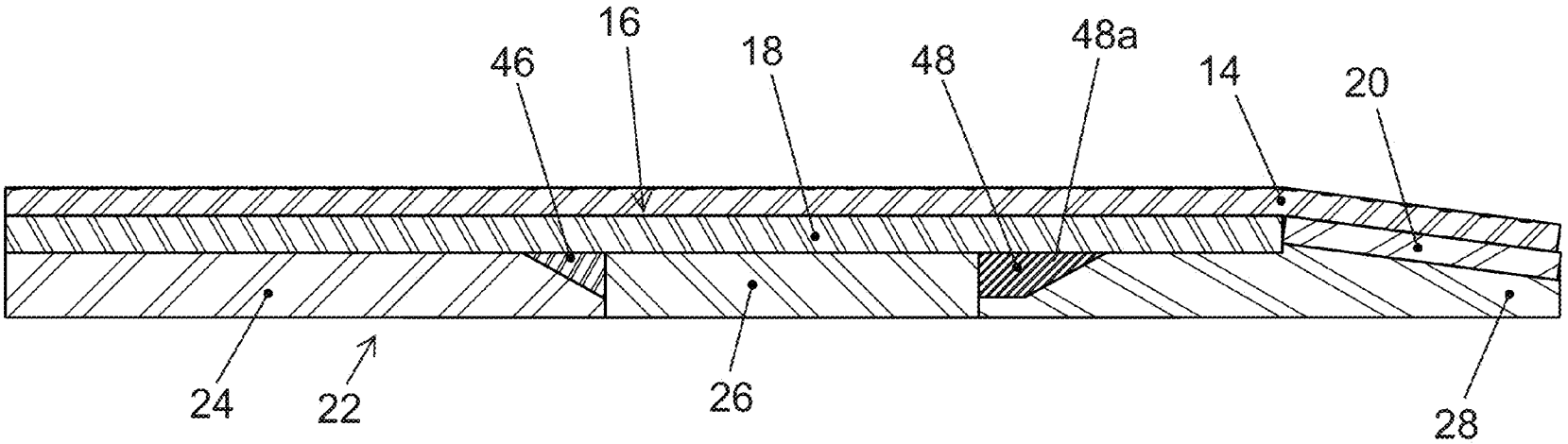
FIG. 5B is a cross-section view taken along line VB-VB of FIG. 5.
Figure 5C:
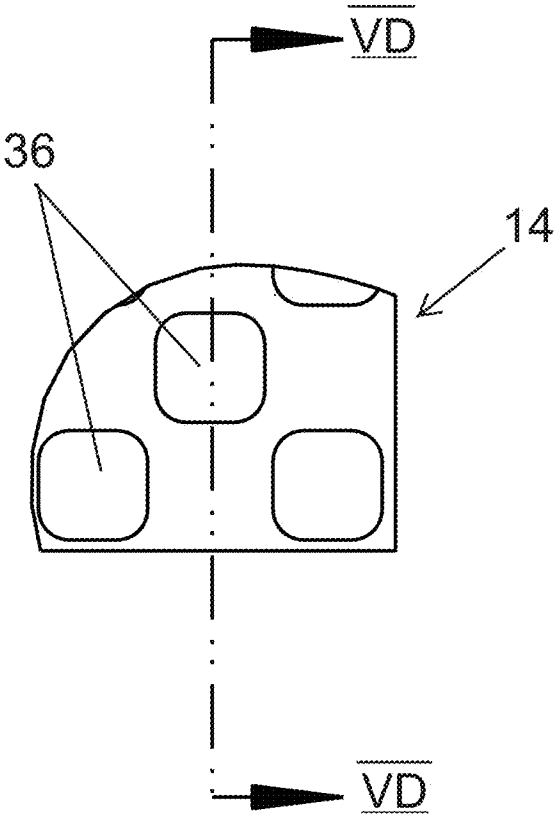
FIG. 5C is an enlarged detailed view of region VC-VC of FIG. 5.
Figure 5D:
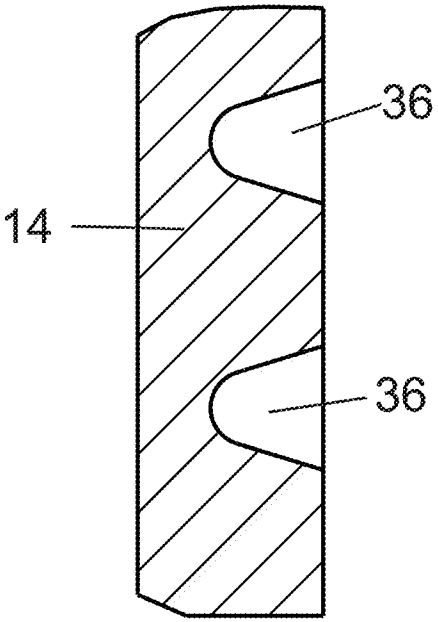
FIG. 5D is a cross-section view taken along line VD-VD of FIG. 5C.

As noted above, upper layer 14 may be formed from a sheet of foam. For example, a suitable foam is a very soft foam and has an IFD (Indentation Force Deflection measured per ASTM D3574) in a range of 9 to 14 and a density in a range of 1.8 to 1.9 pcf (pounds per cubit foot). For example, a commercially suitable foam is sold under the product name Ultracel 1811, by Valle Foam Industries of Brampton, Canada. Further, upper layer 14 generally has a uniform depth or thickness in a range of 1 to 2 inches, optionally in a range of 1.25 to 1.75 inches, and optionally having a thickness of about 1.5 inches. In addition, as best seen in FIGS. 5C and 5D, layer 14 optionally includes a plurality of recesses 36, which extend into layer 14 from its upper surface but terminate such that the recesses do not extend fully through the foam layer. For example, recesses 36 may be arranged in a geometric array, such as shown in FIG. 5, and, further, in rows, which are offset from each other to form a generally diamond-shaped pattern. Alternately, the recesses may be arranged in groups, with each group having the same density or different density. For example, where increased firmness is desired, the density of the recesses may be reduced. Each of the recesses may be circular, rectangular, or rounded squares and have a transverse direction or width (or radius) in a range of 0.5 to 1.5 inches, optionally in a range of 0.75 to 1.25 inches, and optionally approximately 1 inch. Further, the depth of the recess may be approximately equal to their width for example in a range of 0.5 to 1.5 inches, in a range of 0.75 to 1.25 inches, and optionally approximately 0.9 inches. The spacing between each recess may be approximately equal to its width (or radius), for example in a range of 0.5 to 1.5 inches, optionally in a range of 0.75 to 1.25 inches, and optionally about 1 inch. The recesses are used to reduce to firmness of the foam and optionally to reduce the firmness in selected regions across the foam.

In the illustrated embodiment and as described above, intermediate layer 16 may be formed from two sheets 18 and 20 of foam. Sheet 18 generally has the same width dimension as upper layer 14 but terminates adjacent the foot section of the patient support, where it generally abuts the edge of layer 20, which similarly has a similar width dimension as upper layer 14 but extends only over the foot section of support 10. Layer 18 optionally has a generally solid foam configuration and is formed from a firmer foam than upper layer 14, for example a foam having an IFD in a range of 32 to 38 and a density in a range of 1.6 to 1.75 pcf. A commercially suitable foam is sold under product no. 1735AN-RBR (Valle Foam). The thickness of layer 18 falls in a range of 1 to 2 inches, optionally in a range of 1.25 to 1.75 inches, or optionally approximately 1.5 inches.

Sheet 20 is formed from a similar foam and has a similar configuration to upper layer 14, for example, is formed from a very soft foam having an IFD in a range of 9 to 14, and a density in a range of 1.8 to 1.9 pcf, and further optionally includes recesses as described in reference to upper layer 14. In this manner, the foot section of the support has two layers of similar firmness and density to provide a very soft foot end of the support where the patient's heels would be resting.

To further reduce the pressure on the patient's heels, bottom layer 22 includes a wedge-shaped section 28 beneath layer 20 with an angle in a range of 5° to 10°, optionally in a range of 6° to 9°, and optionally approximately 7.6° m which helps reduce the risk of heel breakdown. Wedge-shaped section 28 is optionally formed from a soft foam, such as a foam with an IFD in a range of 12 to 18, and a density in a range of 1.6 to 1.7 pcf. A suitable foam is sold under the product number 1716AM-RBR (Valle Foam). In this manner, the foot end of the support optionally includes three stacked layers of soft foam to reduce the pressure on the patient's heels and, further, forms an angled foot end, which further reduces the pressure on the patient's heels.

As noted above and as best seen in FIG. 7, layer 22 also includes head end section 24, which is formed from a soft foam and may have an IFD in a range of 12 to 18, and a density in a range of 1.6 to 1.7 pcf similar to wedge 28. Section 24 has a generally uniform thickness, for example in a range of 3 to 4 inches, optionally in a range of 3.25 inches to 3.75 inches, and optionally about 3.5 inches. Section 24 also may have a wedged-shaped edge or section, for example which is angled in a range of 25 degrees to 35 degrees, optionally in a range of 27 to 32 degrees, and optionally about 29 degrees and which has a length in a range of 4 to 5 inches, optional y in a range of 4.25 to 4.75, and optionally of about 4.5 inches. The wedged-shaped section cooperates with and formed a base for a wedge member described below, which provides a transition section between regions with difference firmness levels. Section 24 may also include a plurality of recesses formed therein similar to the recesses in upper layer 14 and foot section 20.

To provide support for typically the heaviest part of the patient's body, namely the sacrum area, bottom layer 22 includes gel-based cushioning assembly 26, which has the greatest firmness of any of the layers forming the patient support surface portion of patient support 10 (i.e. other than the rails). For example, the gel-based cushioning layer may have an IFD in a range of 40 to 100, optionally in a range of 50 to 90, optionally in a range of 60 to 70, and optionally with an IFD of about 65. Alternately, the gel may have a firmness in a range of 29 to 35 (measured at 50% deflection of 50 sq. inch area).

Figure 10:
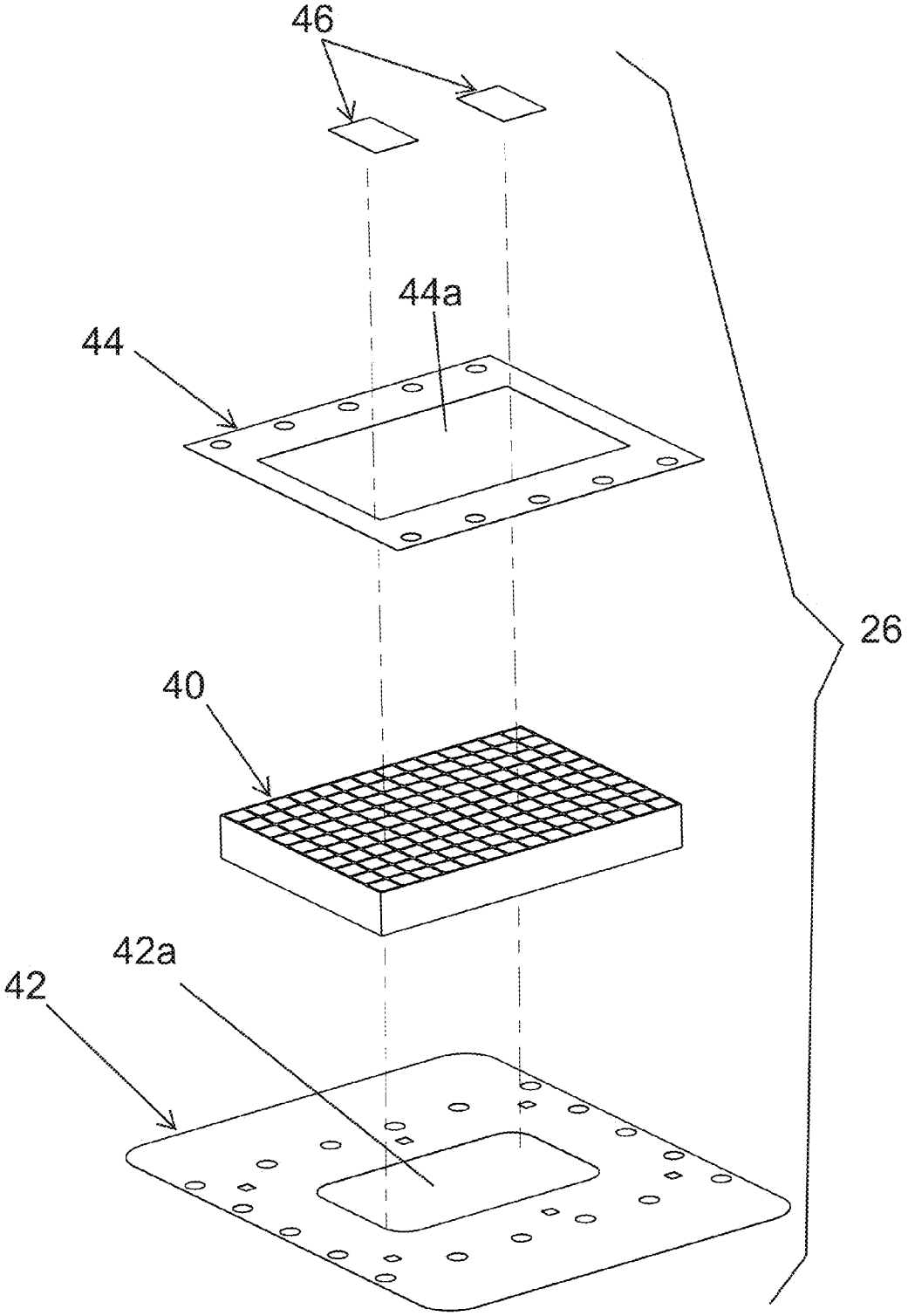
FIG. 10 is an exploded perspective view of the gel-based cushioning assembly of FIGS. 8 and 9.

As best seen in FIG. 10, gel-based cushioning assembly 26 includes a dry polymer gel layer or core 40, a base sheet 42, and an upper sheet 44, which are adhered to the respective upper and lower surfaces of gel layer 40 to provide an anchorage system for the gel layer. For example, sheets 42 and 44 are formed from a non-woven, such as 6/6 nylon. Gel layer 40 may be formed from a number of suitable gels, such as described below, and a number of different gel configurations, including the buckling column configurations, which are formed by intersecting walls, such as described in the referenced patents. For example, gel layer 40 may be formed by a plurality of intersecting gel walls that form a matrix with hollow spaces formed between the gel walls. One group of walls may be orthogonal to the other group of walls as shown so that the spaces are rectangular or square or they may be angled and further include additional groups of walls so that the each of the spaces may be formed by walls that form acute angles and/or may have different shapes other than rectangular or square and further may vary in size. Additionally, while shown as extending all the way through the gel layer, the spaces may be closed on one end or somewhere intermediate their ends by a gel skin layer.

So as to not interfere with the compression or envelopment characteristics of gel core 40, base and upper sheets 42 and 44 each have a central opening 42*a* and 44*a*, respectively, and are each secured to the gel layer around the gel layers perimeter, for example by welding, such as described in the referenced patents and co-pending applications noted below. When assembled, each of the base and upper sheets 42 and 44 can then be anchored to the adjacent or upper foam layers using an adhesive. Therefore, base and upper sheets 42 and 44 anchor and secure the gel core 40 to the other layers but without impeding or hampering the immersion and buckling characteristics of the gel walls of the core layer. In addition to non-woven sheets 42 and 44, gel-based cushioning assembly 26 may optionally include one or more non-woven patches 46 (sized so that they do not extend beyond one or two walls), which are welded to the upwardly facing side of gel core 40 to provide anchor points, for example, to anchor gel-based cushioning assembly 26 to layer 18.

Suitable dry polymer gels or gelatinous elastomeric materials for forming the gel core may be formed by blending an A-B-A triblock copolymer with a plasticizer oil, such as mineral oil. The "A" component in the A-B-A triblock copolymer is a crystalline polymer like polystyrene and the "B" component is an elastomer polymer like poly(ethylene-propylene) to form a SEPS polymer, a poly (ethylene-butadyene) to form a SEBS polymer, or hydrogenated poly(isoprene+butadiene) to form a SEEPS polymer. For examples of suitable dry polymer gels or gelatinous elastomeric materials, the method of making the same, and various suitable configurations for the gel layer reference is made to U.S. Pat. Nos. 3,485,787; 3,676,387; 3,827,999; 4,259,540; 4,351,913; 4,369,284; 4,618,213; 5,262,468; 5,508,334; 5,239,723; 5,475,890; 5,334,646; 5,336,708; 4,432,607; 4,492,428; 4,497,538; 4,509,821; 4,709,982; 4,716,183; 4,798,853; 4,942,270; 5,149,736; 5,331,036; 5,881,409; 5,994,450; 5,749,111; 6,026,527; 6,197,099; 6,843,873; 6,865,759; 7,060,213; 6,413, 458; 7,730,566; 7,823,233; 7,827,636; 7,823,234; and 7,964,664, which are all incorporated herein by reference in their entireties. Other suitable configurations are described in copending application, entitled PATIENT SUPPORT, Ser. No. 61/697,010, filed Sep. 5, 2012, commonly owned by Stryker Corp. of Kalamazoo, Mich., which incorporated herein by reference in its entirety.

Other formulations of gels or gelatinous elastomeric materials may also be used in addition to those identified in these patents. As one example, the gelatinous elastomeric material may be formulated with a weight ratio of oil to polymer of approximately 3.1 to 1. The polymer may be Kraton 1830 available from Kraton Polymers, which has a place of business in Houston, Tex., or it may be another suitable polymer. The oil may be mineral oil, or another suitable oil. One or more stabilizers may also be added. Additional ingredients—such as, but not limited to—dye may also be added. In another example, the gelatinous elastomeric material may be formulated with a weight ratio of oil to copolymers of approximately 2.6 to 1. The copolymers may be Septon 4055 and 4044 which are available from Kuraray America, Inc., which has a place of business in Houston, Tex., or it may be other copolymers. If Septon 4055 and 4044 are used, the weight ratio may be approximately 2.3 to 1 of Septon 4055 to Septon 4044. The oil may be mineral oil and one or more stabilizers may also be used. Additional ingredients—such as, but not limited to—dye may also be added. In addition to these two examples, as well as those disclosed in the aforementioned patents, still other formulations may be used.

As noted above, gel-based cushioning assembly 26 is located between foam sheet or section 24 and foam section 28 such that it aligns generally with the sacrum area of the patient. In this manner, the sacrum area of patient support 10 has a generally soft topper formed by upper layer 14 but which increases in firmness by way of layers 18 and gel-based cushioning assembly 26. At the same time, the walls of gel core 40 buckle when the pressure due to the patient bearing on the support surface exceeds a predetermined level of immersion to thereby redistribute the pressure to the other walls in the gel layer so that pressure is redistributed across the sacrum area of the support. Thus, the pressure redistribution is achieved by isolating the sacral region with the gel technology.

Optionally, patient support 10 may include transitional layers between the softer layers and the more firm layers of patient support. For example, referring to FIG. 5B patient support 10 may optionally include a transition between foam section 24 and gel-based cushioning assembly 26 and, further, between gel cushion assembly 26 and foam wedge 28. For example, a foam insert may be provided at the interface between gel cushion assembly 26 and foam section 24 in the form of a wedge-shaped foam member 46, which is firmer than foam section 24 but less firm than gel-based cushioning assembly 26. For example, wedge-shaped foam member 46 may have an IFD in a range of 38 to 46 and a density in a range of 1.65 to 1.95 pcf. Further, with its wedge-shaped configuration, which matches the wedge-shaped edge of foam section 24, the firmness increases along the longitudinal direction of patient support 10, increasing from the head end to the sacral region of the support.

Similarly, a second generally wedge-shaped foam member 48 may be positioned between gel-based cushioning assembly 26 and foam wedge 28. For example, member 48 may be formed from a similar material to member 46 (namely a foam having an IFD in a range of 38 to 46 with a density in a range of 1.65 to 1.95 pcf, available under the product number 1842AM-RB (Valle Foam)). Member 48 may similarly have a wedge section 48*a* which is similar to member 46 so that the stiffness of the insert decreases between the interface of gel-based cushioning assembly 26 and wedge 28 in the direction of the feet and, further, matches the wedge-shaped edge of wedge-shape section 28. Further, member 48 is located in the knee region of a patient and in effect forms a hinge effect at the knee region to further reduce the stress on the patient's heels. Additionally, member 48 creates a positioning pocket that helps prevent the patient from sliding down the mattress.

While described above in reference to comprising a foam upper layer, upper layer 14 may alternately be formed from a gel material and have a configuration similar to gel core 40, where the recesses optionally extend all the way from the layer to form collapsible column walls, as described in the referenced patents.

As noted above, at least rails 30 are formed from a foam with a greater firmness than any of the other components forming patient support 10. For example, a suitable foam forming rails 30 may have an IFD in a range of 60 to 70 with a density in a range of 1.4 to 1.5 pcf. One suitable foam is available under the Product No. 1565AM-RBR (Valle Foam). The dimensions of rails 30 may be varied but may fall in the range of 5 to 6 inches tall, in a range of 5.25 to 5.75 inches tall, and optionally approximately 5% inches. The width of rails 30 may fall in the range of 3 to 4 inches, optionally in a range of 3.25 to 3.75 inches, and optionally approximately 3.5 inches. As noted above, the wedge-shaped end of rails 30 generally matches the slope of wedge-shape 28 and, therefore, similarly falls in a range of 5° to 10°, optionally in a range of 6° to 9°, optionally in a range of 7° to 8°, and optionally about 7.6°.

Rails 32 similarly has an increased firmness over many of the components of patient support 10 but optionally is less firm than rails 30 and may be formed from a foam with an IFD in a range of 38 to 46, and a density in a range of 1.65 to 1.95 pcf similar to members 46 and 48. For example, rails 32 may have a width approximately equal to the width of rails 30 and may have a height in a range of 1 to 2 inches, optionally in a range of 1.25 to 2.25 inches, optionally in a range of 1.5 to 2 inches, and optionally approximately 1.75 inches.

Figure 7:
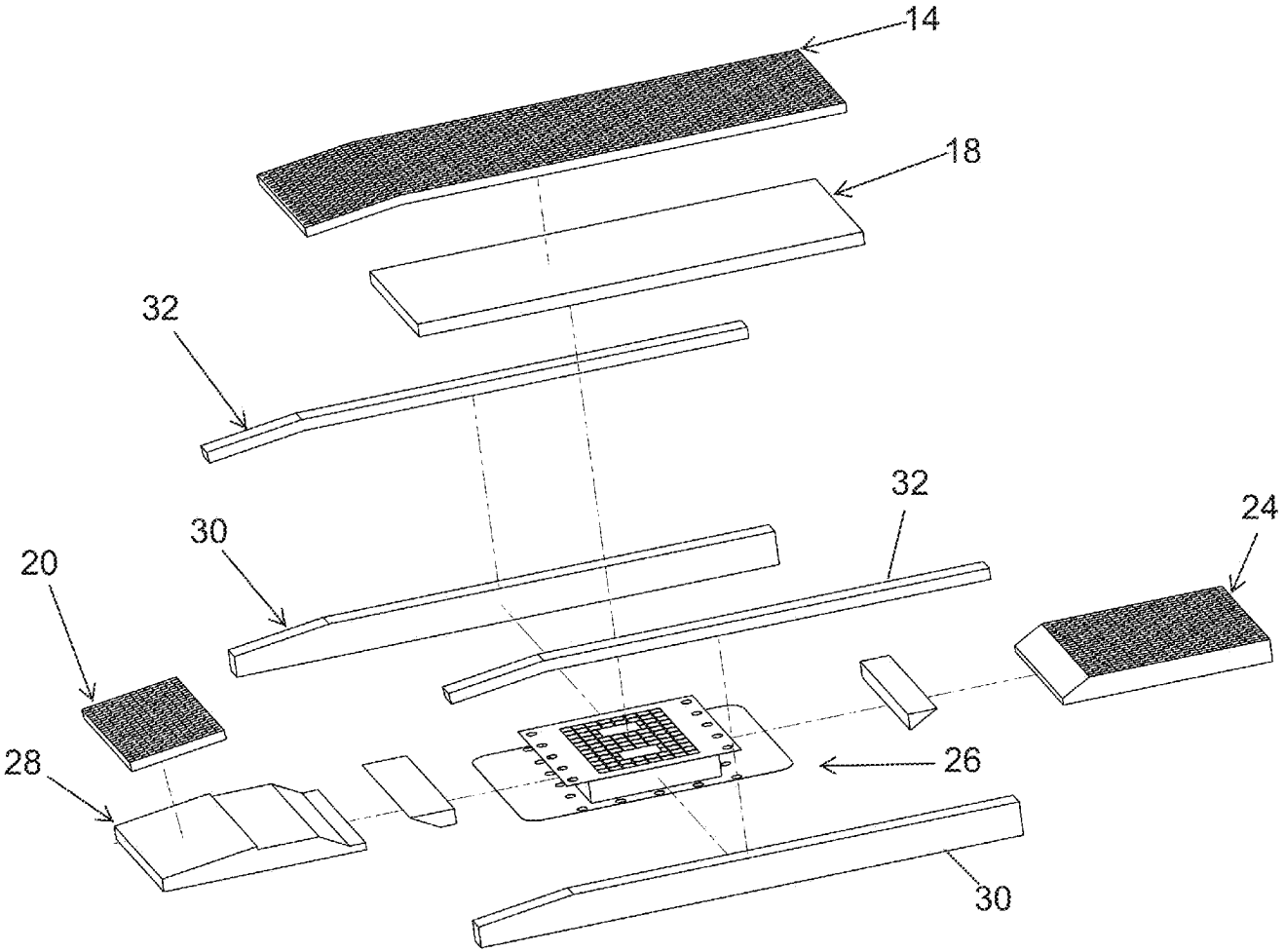
FIG. 7 is an exploded perspective view of the patient support of FIG. 3 illustrating the system of layers forming the patient support.
Figure 9:
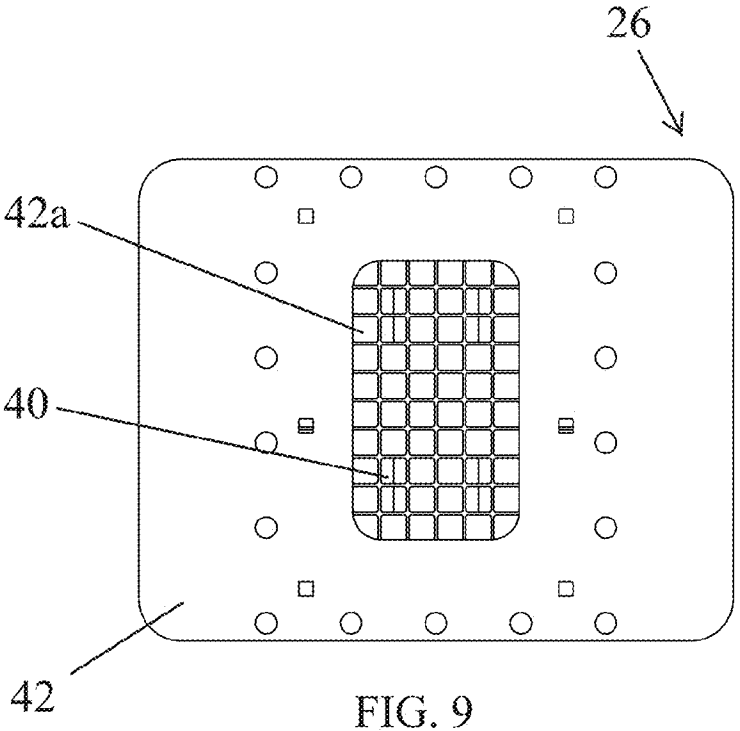
FIG. 9 is a bottom plan view of the gel-based cushioning assembly of FIG. 8.
Figure 8:
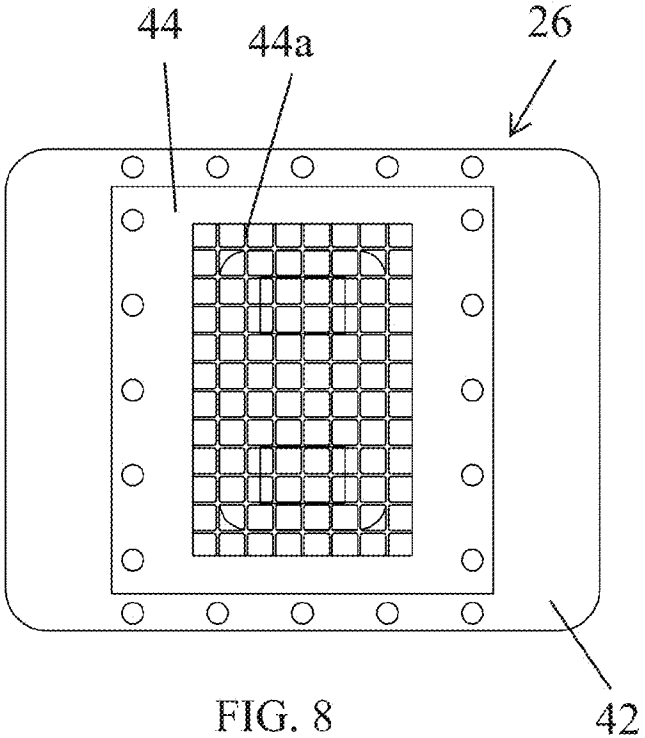
FIG. 8 is a top plan view of the gel-based cushioning assembly of FIGS. 4 and 7.

As best understood from FIG. 7, member 46 may extend across the full width of the patient support surface section of patient support 10 and have a height in a range of 2 to 3 inches, optionally in a range of 2.25 to 2.75 inches, and optionally approximately 2.5 inches. The length of member 46 may fall in a range of 4 to 5 inches, optionally in a range of 4.25 to 4.75 inches, and optionally approximately 4.5 inches. Thus, member 46 may have a slope of approximately 30°, which generally matches the slope of the wedge-shaped section or edge of foam section 24.

Insert 48 may similarly have a slope of 30° and have a similar thickness or height as wedge 46 but instead has a trapezoidal-shape with a height optionally in a range of 2 to 3 inches, optionally in a range of 2.25 to 2.75 inches, and optionally approximately 2.4 inches, and a length optionally in range of 6.5 to 7.5 inches, optionally in a range of 6.75 to 7.25 inches, and optionally approximately 6.9 inches. The angled face of the wedge may be offset from the rectangular base of the trapezoid in a range of 2 to 3 inches, optionally in a range of 2.25 to 2.75 inches, and optionally approximately 2.5 inches.

Wedge 28 also optionally extends across the full width of the patient support surface formed by patient support 10 and includes a step profile starting at the foot end with a ramped portion forming an angle, as noted above in a range of 5° to 10°, in a range of 6° to 9°, in a range of 7° to 8°, and approximately 7.6°, and a stepped down portion, which is generally horizontal and receives layer 18. Adjacent the stepped portion is a reverse sloped section, which is angled in a range of approximately 24° to 34°, optionally in a range of 26° to 32°, and optionally approximately 29°, and a second stepped portion which is generally horizontal to abut gel cushioning assembly 26. In this manner, wedge-shaped member 48 is trapped between layer 18 and wedge 28 by gel cushion assembly 26 whose non-woven base layer is secured to the lower facing surfaces of wedge section 28 and foam section 24 using an adhesive. Further, as would be understood, each of the adjacent facing surfaces of each of the foam members may be glued together to form a monolithic cushion.

Once assembled and glued together, the foam layers and gel layer are then enclosed in a fire sock (not shown) and an optional antimicrobial sock, and thereafter cover 12 (FIG. 1), which may be formed from a top sheet of 70 denier nylon taffeta with a rubberized coating, which is available from Stratex®, and a bottom sheet of a standard healthcare fabric available from Vintex, Inc., which are then joined together by stitching and a zipper.

In addition to the wedge-shaped inserts that provide transitions between the different levels of firmness, support 10 may also incorporate wedge-shaped inserts to form additional hinges to allow the support to bend at lateral axes to raise or lower the head or foot sections along the length of the support or along longitudinal axes, such as described in U.S. Pat. No. 7,441,290, to allow turning of the patient, which is commonly assigned to Stryker Corporation and which is incorporated by reference in its entirety herein.

Further, support 10 may incorporate bottom-out sensors (such as described in U.S. Pat. No. 6,943,694); tie downs; a low air loss system (such as described in provisional application Ser. No. 61/537,325, filed Sep. 21, 2011, entitled PATIENT SUPPORT SURFACE WITH LOW AIR LOSS SYSTEM); turn assist bladders, such as described in U.S. Pat. No. 8,006,333, and climate management systems (such as described in copending U.S. application Ser. No. 12/640,770, filed Dec. 17, 2009, entitled PATIENT SUPPORT; and Ser. No. 12/640,643, filed Dec. 17, 2009, entitled PATIENT SUPPORT), all of which are incorporated by reference in their entireties herein.

Accordingly, the present invention provides a mattress that can be configured as a non-powered mattress but which can provide pressure redistribution associated with all gel-based mattresses or powered surfaces and further can provide comfort for the patient. With the soft cushioning regions adjacent the firmer sacrum area (provided by the gel layer), the mattress allows the patient to immerse into the patient support surface and be properly aligned on the surface. In addition, as pressure is applied over time, the gel layer can maintain its structure due to its high memory and durability.

Figure 11:
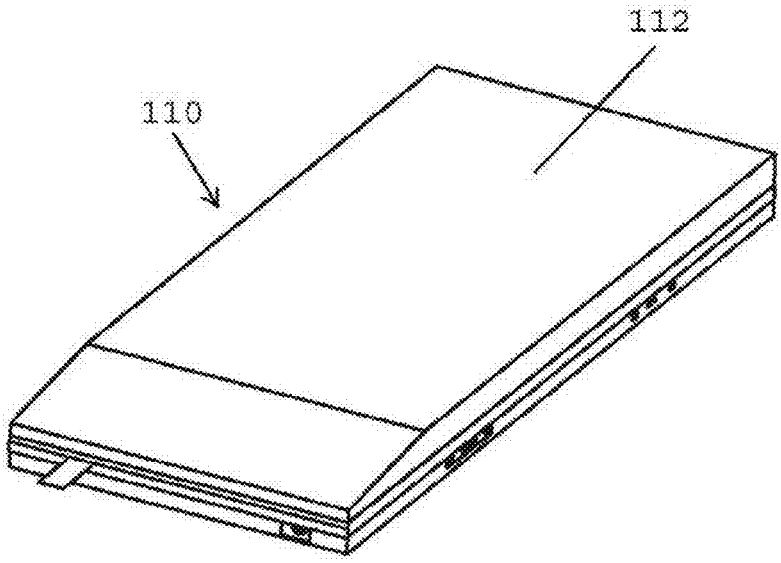
FIG. 11 is a perspective view of another embodiment of a patient support of the present invention.
Figure 11A:
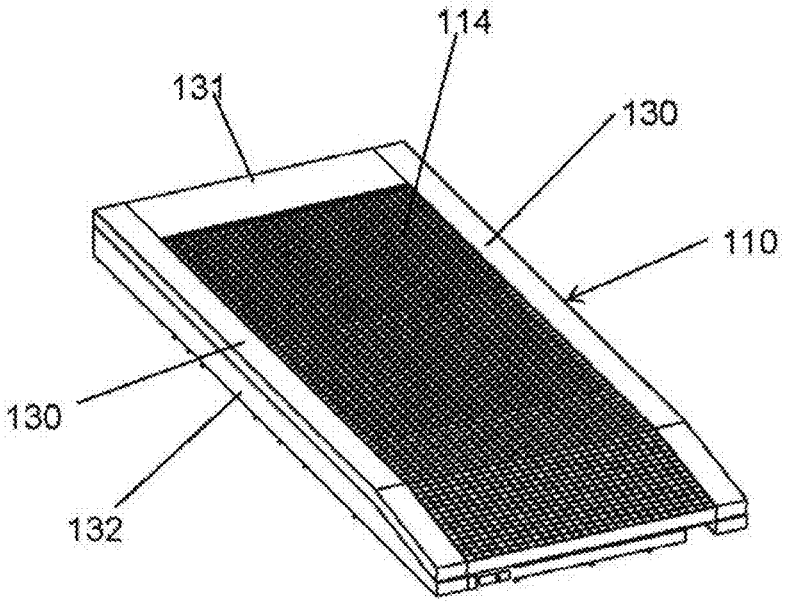
FIG. 11A is a similar view to FIG. 11 with the cover removed.
Figure 12:
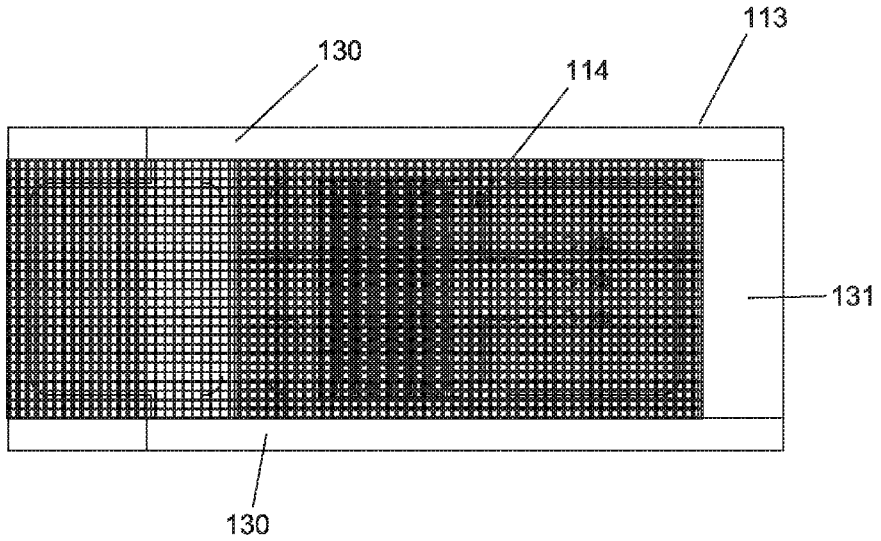
FIG. 12 is a plan view of the patient support of FIG. 11.
Figure 14:
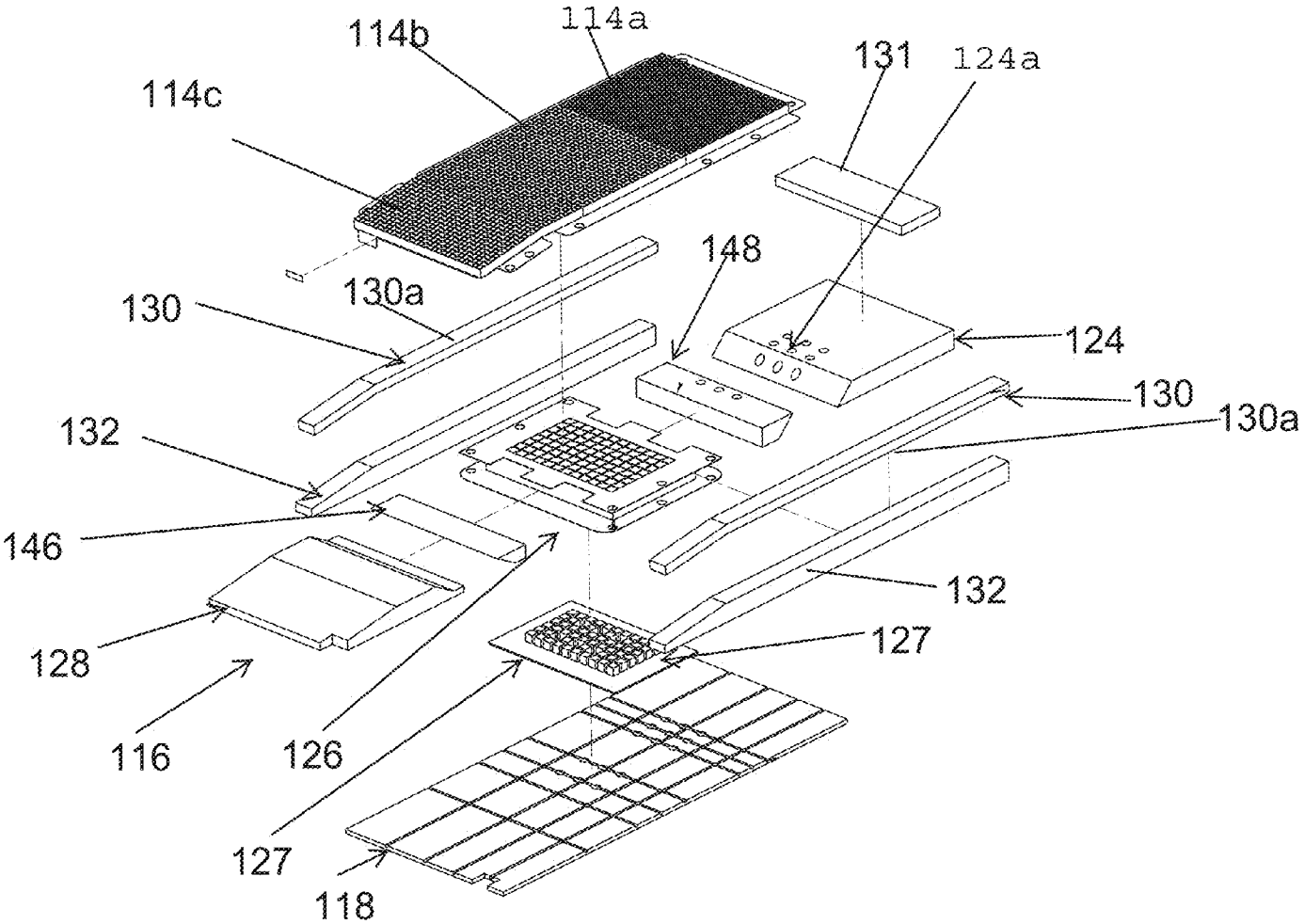
FIG. 14 an exploded perspective view of the patient support of FIG. 12 illustrating the system of layers forming the patient support.
Figure 14A:
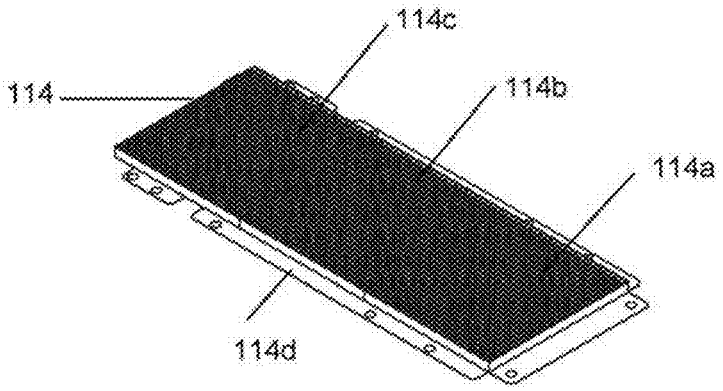
FIG. 14A an perspective view of the top layer of the patient support of FIG. 12.

Referring to FIG. 11, the numeral 110 generally designates another embodiment of a patient support of the present invention shown enclosed in a cover 112. As best seen in FIGS. 11A and 14, patient support 110 includes a cushioning system with an upper layer 113, which may include a dry polymer or elastomeric gel layer 114, of the type described above, and foam side and head rails 130, 131, an intermediate layer 116, and base foam layer 118. As will be more full described below, base foam layer 118 may be configured as a low air loss system carrier.

Figure 13:
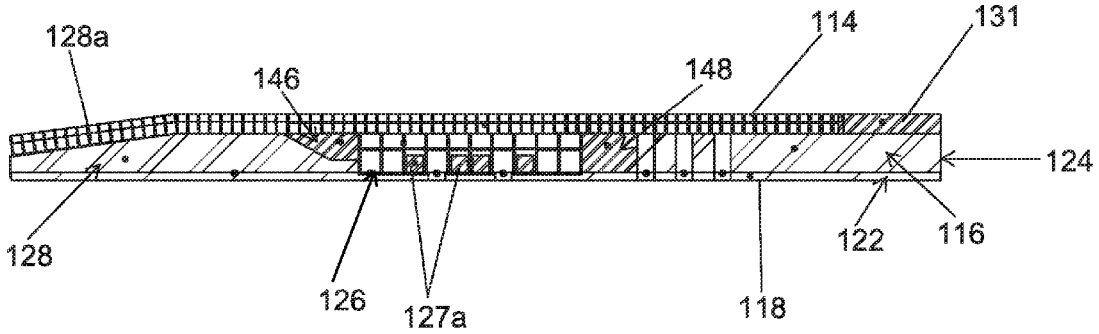
FIG. 13 is cross-section view taken through the center of the support of FIG. 12.

Gel layer 114 may be formed from a single sheet of gel or, as shown the illustrated embodiment, may be formed from multiple gel sections. As best seen in FIGS. 14A-14D, layer 114 may be formed from three gel sections 114*a*, 114*b*, and 114*c*, each mounted to a carrier sheet 114*d* of non-woven material, by for example, an adhesive, which provides an anchorage system for the gel sections to the underlying foam layers described below. As best seen in FIG. 13, gel layer 114 is located above intermediate layer 116, which comprises a foam head end sheet or section 124, a dry polymer gel-based cushioning assembly 126, which is in the sacrum region of the support, a foam foot end sheet or section 128. Section 128 has a wedge shape to reduce the pressure on the heels of a patient. Extending along the sides of sections 124, 128 and gel-based cushioning assembly 126 are a pair of lower side rails 132, which extend from the head end to the foot end of support 110. Foam sheets and sections described above may be formed from a unitary piece of foam or may be formed from multiple layers with similar or varying properties. Further additional layers (not shown) may be interposed between each of the respective layers.

In the illustrated embodiment, carrier sheet 114*d* of gel layer 114 is adhered, for example, using a conventional adhesive to the lower rails 132 and optimally to each of the foam sections forming intermediate layer 116. To that end, the upper rails 130 are configured so that their upper surfaces (130*a*) are generally coplanar with and follow the surface topology of the upper surface of the gel layer 114. For example, in the illustrated embodiment, the foot ends of lower rails 132 each have a wedge shape that is angled downwardly at approximately the same angle as the foot end section of layer 116, described more fully below.

Rails 130 and 132 are each formed from foam, with at least the lower or base rails (132) being firmer than any of the components forming layers 114, 116, and 122 so that together with head rail 131 form a crib to facilitate retention of the upper gel layer and, moreover, form a firmer edge for support 110 to facilitate ingress and egress and also to help prevent the patient from rolling off the patient support. Rails 130 and 132 are glued together at their interface to form a composite rail. Optionally, rails 130 and 132 may also be used for line management, e.g. to contain conduits, such as tubing, which may be used to direct fluid, namely air, to an optional low air loss or cooling system.

As noted above, upper layer 114 may be formed from a sheet of gel. For example, suitable dry polymer gels or gelatinous elastomeric materials for forming the gel core may be formed by blending an A-B-A triblock copolymer with a plasticizer oil, such as mineral oil. The "A" component in the A-B-A triblock copolymer is a crystalline polymer like polystyrene and the "B" component is an elastomer polymer like poly(ethylene-propylene) to form a SEPS polymer, a poly (ethylene-butadyene) to form a SEBS polymer, or hydrogenated poly(isoprene+butadiene) to form a SEEPS polymer. For examples of suitable dry polymer gels or gelatinous elastomeric materials, the method of making the same, and various suitable configurations for the gel layer reference is made to U.S. Pat. Nos. 3,485,787; 3,676,387; 3,827,999; 4,259,540; 4,351,913; 4,369,284; 4,618,213; 5,262,468; 5,508,334; 5,239,723; 5,475,890; 5,334,646; 5,336,708; 4,432,607; 4,492,428; 4,497,538; 4,509,821; 4,709,982; 4,716,183; 4,798,853; 4,942,270; 5,149,736; 5,331,036; 5,881,409; 5,994,450; 5,749,111; 6,026,527; 6,197,099; 6,843,873; 6,865,759; 7,060,213; 6,413, 458; 7,730,566; 7,823,233; 7,827,636; 7,823,234; and 7,964,664, which are all incorporated herein by reference in their entireties. Other suitable configurations are described in copending application, entitled PATIENT SUPPORT, Ser. No. 61/697,010, filed Sep. 5, 2012, commonly owned by Stryker Corp. of Kalamazoo, Mich., which incorporated herein by reference in its entirety.

Figure 14B:
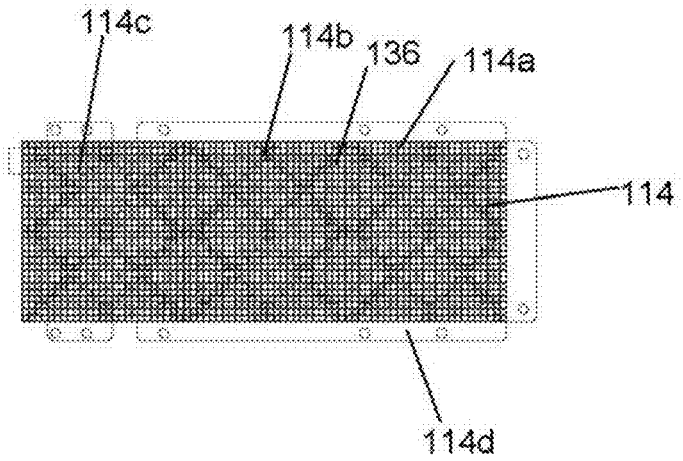
FIG. 14B is a top plan view of the top layer of the patient support of FIG. 12.
Figure 14D:
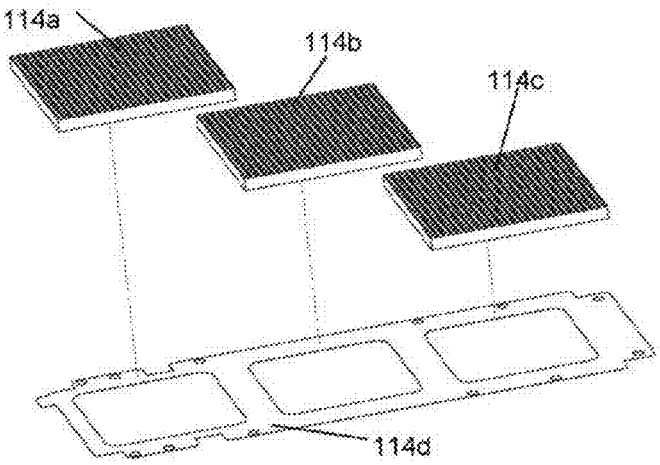
FIG. 14D is an exploded perspective view of the layer of FIG. 14A.
Figure 14C:
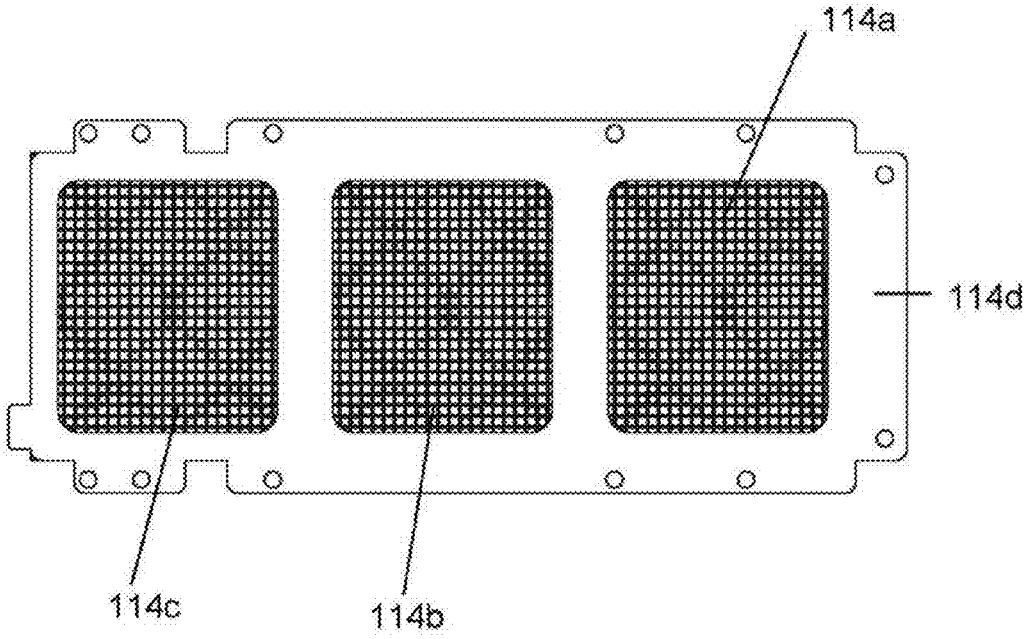
FIG. 14C is a bottom plan view of the top layer of the patient support of FIG. 12.
Figure 14E:
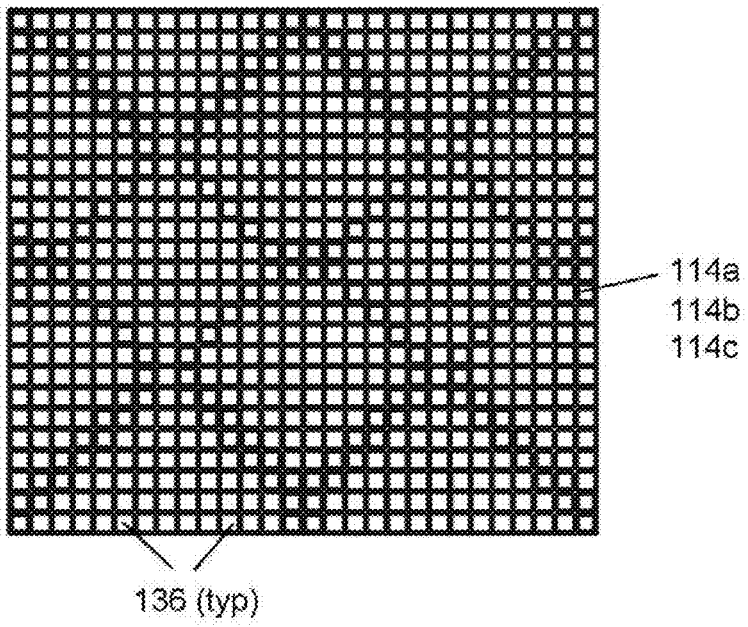
FIG. 14E is an enlarged plan view of one section of the layer of FIG. 14A.
Figure 14F:
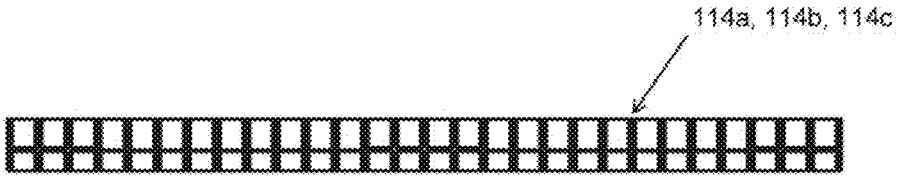
FIG. 14F is an enlarged side view of one section of the layer of FIG. 14A.
Figure 14G:
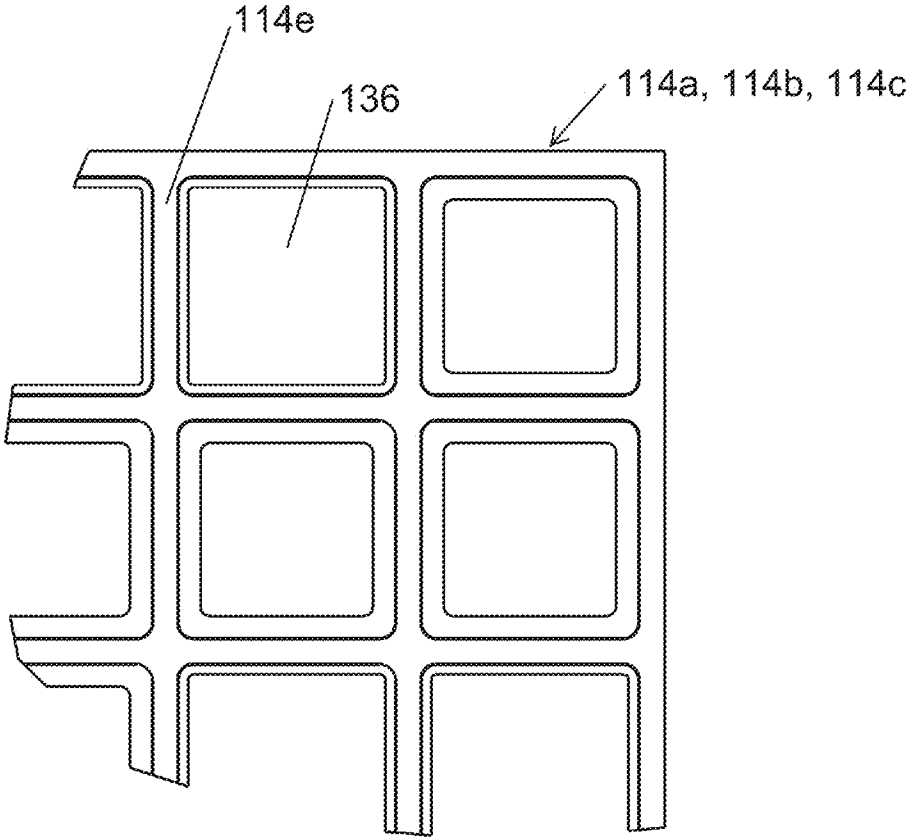
FIG. 14G is an enlarged fragmentary view of one section of the layer of FIG. 14A.
Figure 15:
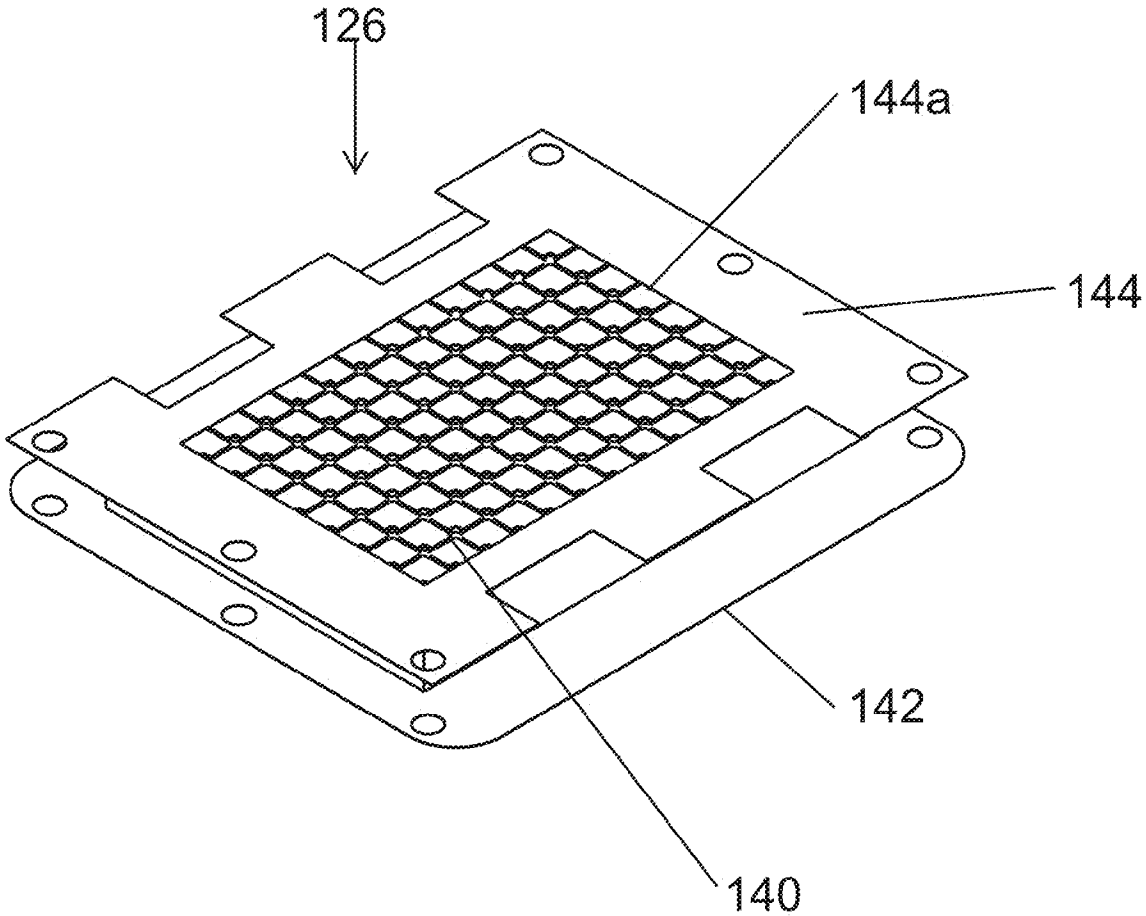
FIG. 15 is an enlarged perspective view of a gel-based cushioning assembly of FIG. 14.

In addition, as best seen in FIGS. 14B and 14E, each layer 114*a*, 114*b*, and 114*c* includes a plurality of transverse passage ways 136, which extend through gel layer 114 from its upper surface to its lower surface and therefore allow air flow through layer 114. For example, as shown, passageways 136 may be arranged in a geometric array, such as shown in FIGS. 14B, 14C, and 14E, and, further, in rows, which are aligned with each other to form a matrix. Alternately, the passageways may be arranged in groups, with each group having the same density or different density. For example, where increased firmness is desired, the density of the passageways may be reduced. Each of the passageways may be circular, rectangular, or rounded squares and have a transverse dimension or width (or radius) in a range of 0.5 to 1.5 inches, optionally in a range of 0.75 to 1.25 inches, and optionally approximately 1 inch. Further, the depth of the passageways may be approximately equal or greater to their width for example in a range of 1.0 to 2.50 inches, in a range of 1.25 to 2.00 inches, and optionally approximately 1.75 inches. The space between each passageway or in other words the wall thickness of the gel walls surrounding the passageways is used to control the firmness of the gel layer and optionally to adjust the firmness in selected regions across the layer. For example, the wall thickness may in a range of 1/32 to 1/4 inches, optionally in a range of 1/16 to 1/8 inches, and optionally approximately 0.11 inch.

As referenced above, intermediate layer 116 may be formed from two foam sections 124 and 128, which generally have the same width dimension as gel layer 114 and are joined by gel assembly 126 and further by wedge sections 146 and 148, which as describe below provide a transition between the varying firmness of the layers that make up support 110.

To further reduce the pressure on the patient's heels, wedge-shaped foam section 128 includes an angled upwardly facing surface 128*a* that is angled in a range of 5° to 10°, optionally in a range of 6° to 9°, and optionally approximately 8.0°, which helps reduce the risk of heel breakdown. Wedge-shaped section 128 is optionally formed from a soft foam, such as a foam with an IFD in a range of 18 and under, for example in a range of 12 to 18, and a density in a range of 1.6 to 1.7 pcf or greater. A suitable foam is sold under the product number 1716AM-RBR (Valle Foam). In this manner, the foot end of the support optionally includes a layer of gel and two stacked layers of soft foam to reduce the pressure on the patient's heels and, further, forms an angled foot end, which further reduces the pressure on the patient's heels.

Figure 20:
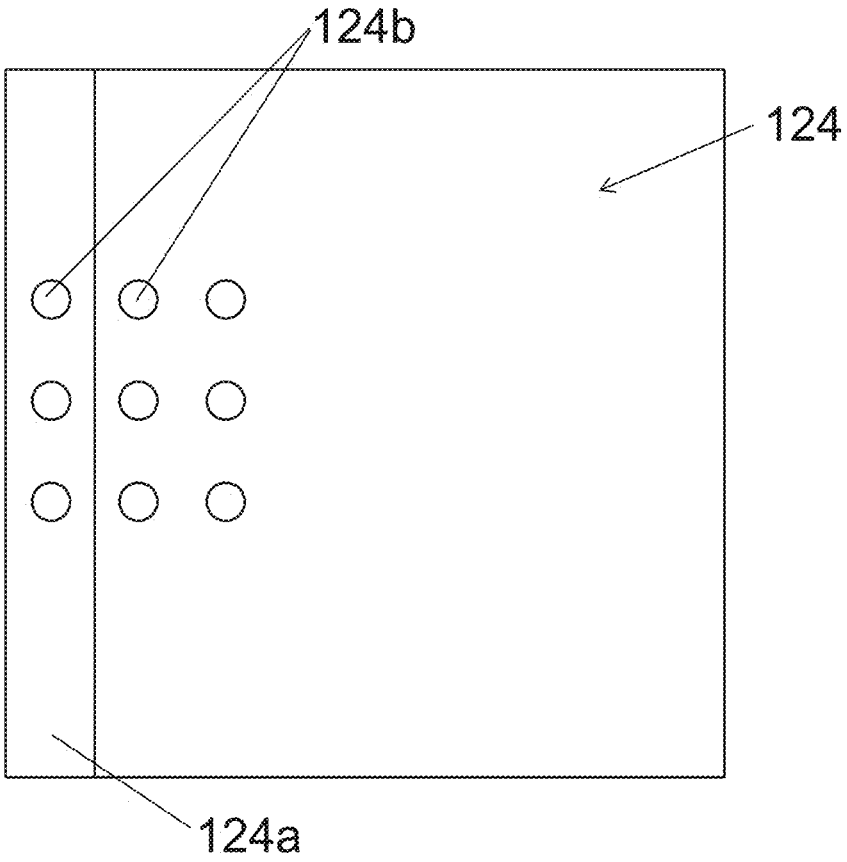
FIG. 20 is a top plan view of a component of the intermediate layer of the patient support of FIG. 12.
Figure 21:
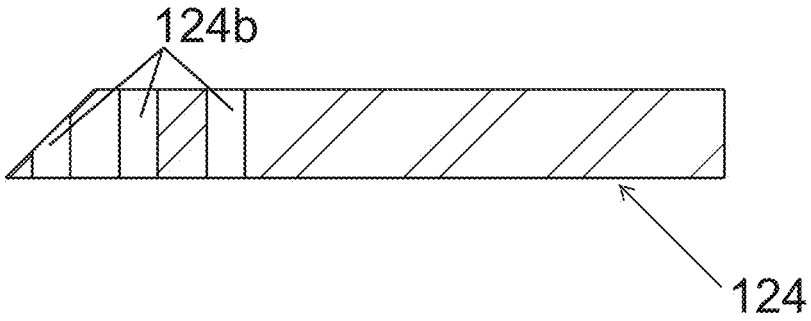
FIG. 21 is an cross-section taken through the component of FIG. 20.
Figure 22:
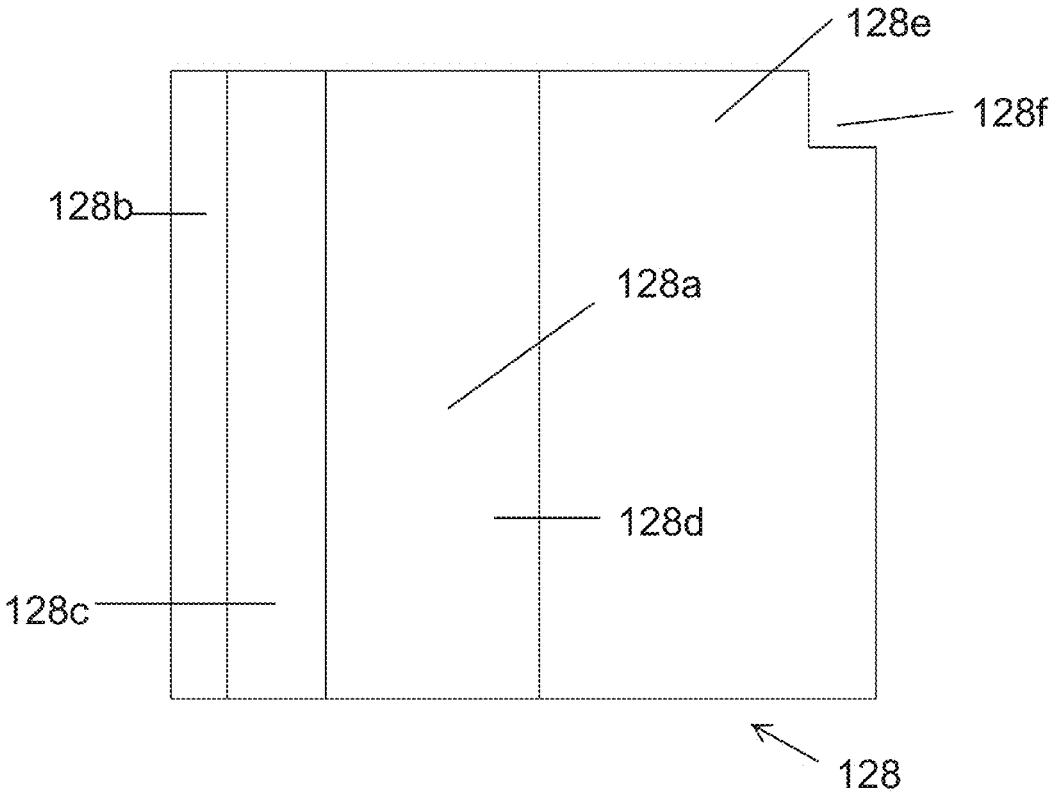
FIG. 22 is a top plan view of another component of the intermediate layer of the patient support of FIG. 12.

As noted above and as best seen in FIGS. 14, 20, and 21, layer 118 also includes head end section 124, which is formed from a soft foam and may have an IFD in a range of 18 and under, for example in a range of 12 to 18, and a density in a range of 1.6 to 1.7 pcf or greater similar to wedge 128. Section 124 has a generally uniform thickness, for example in a range of 3 to 4 inches, optionally in a range of 3.25 inches to 3.75 inches, and optionally about 3.5 inches. As best seen in FIG. 21, section 124 also may have a wedged-shaped edge or section 124*a*, for example which is angled in a range of 35 degrees to 55 degrees, optionally in a range of 40 to 50 degrees, and optionally about 45 degrees and which has a length in a range of 3 to 5 inches, optionally in a range of 3.5 to 4.5 inches, and optionally of about 4.0 inches. The wedged-shaped section cooperates with and forms a base for a wedge member described below, which provides a transition section between regions with difference firmness levels. Section 124 may also include a plurality of transverse passageways 124*b* formed therein for use in the low air loss system described more fully below.

To provide support for typically the heaviest part of the patient's body, namely the sacrum area, as noted layer 118 includes gel-based cushioning assembly 126, which may be less firm than the top layer of gel 114. For example, the gel-based cushioning layer is formed from a similar gel to gel layer 114 but its gel walls are spaced further apart leaving larger passageways between each gel wall. For example, assembly 126 may have an IFD in a range of 12 to 50, optionally in a range of 20 to 40, optionally in a range of 25 to 35 (measured at 50% deflection of 50 sq. inch area).

Figure 16:
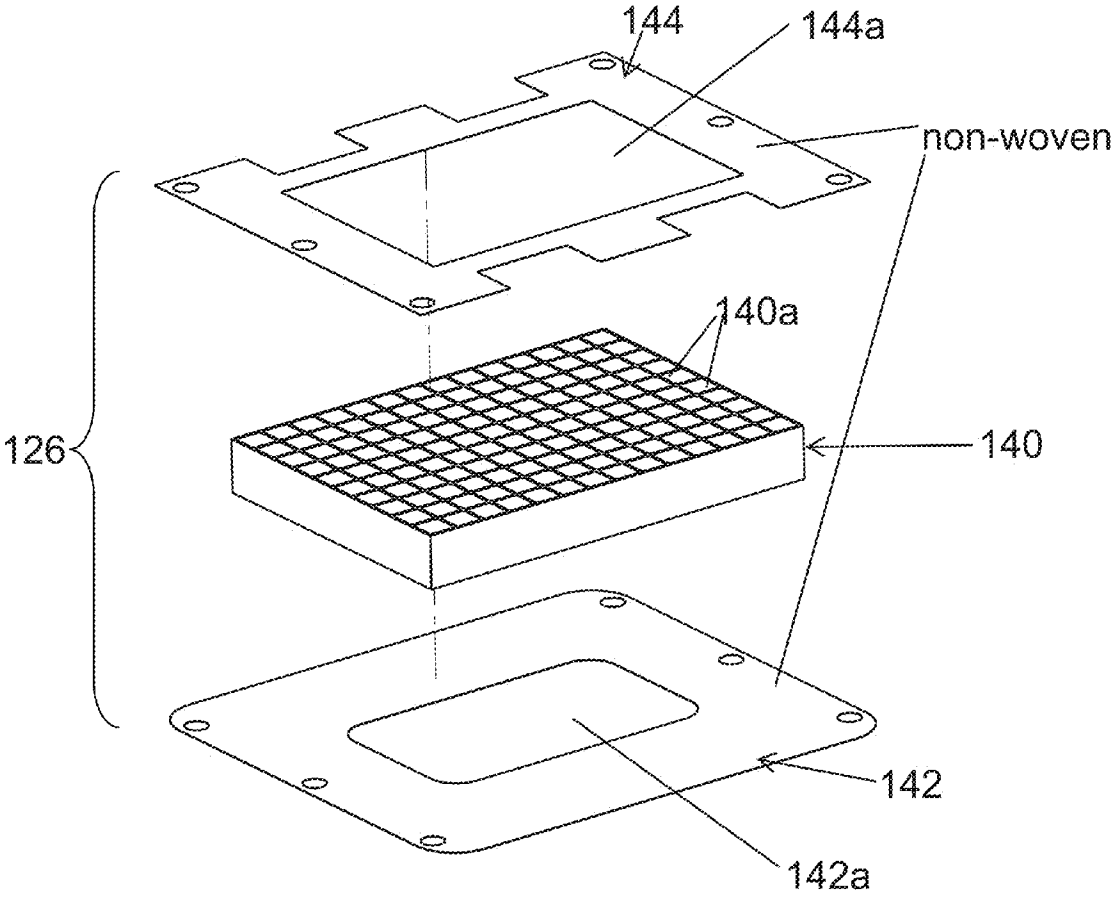
FIG. 16 is an exploded perspective view of the gel-based cushioning assembly of FIG. 15.
Figure 16A:
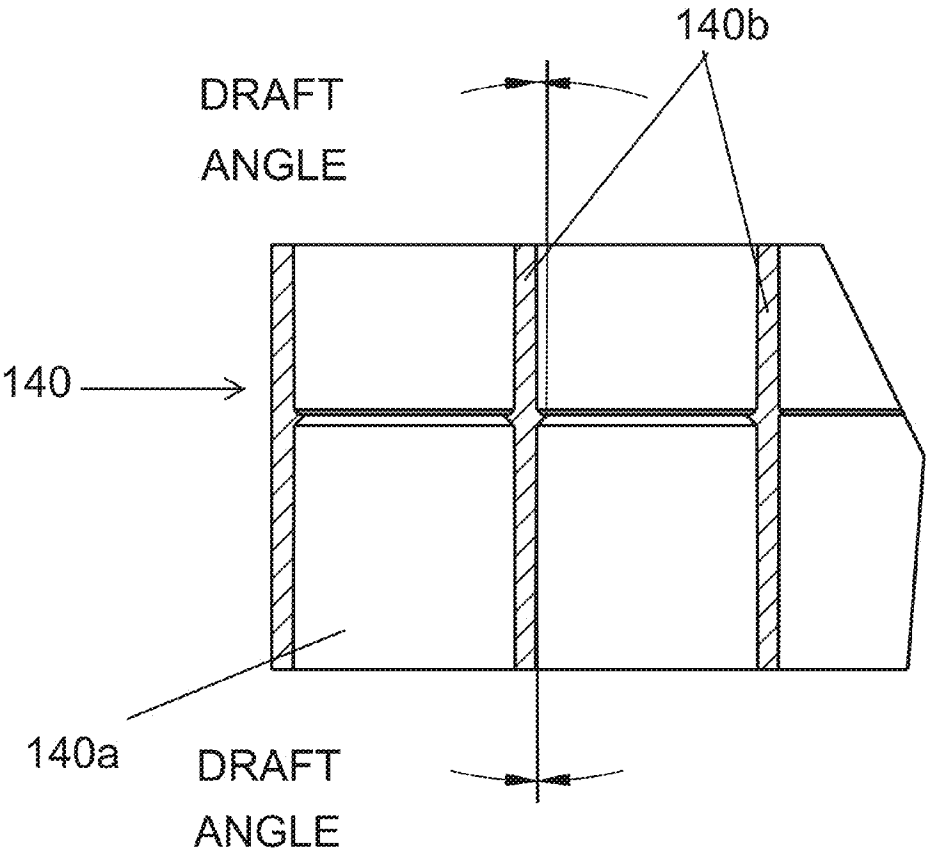
FIG. 16A is an enlarged fragmentary view of one section of the gel layer the gel-based cushioning assembly of FIG. 15.
Figure 17:
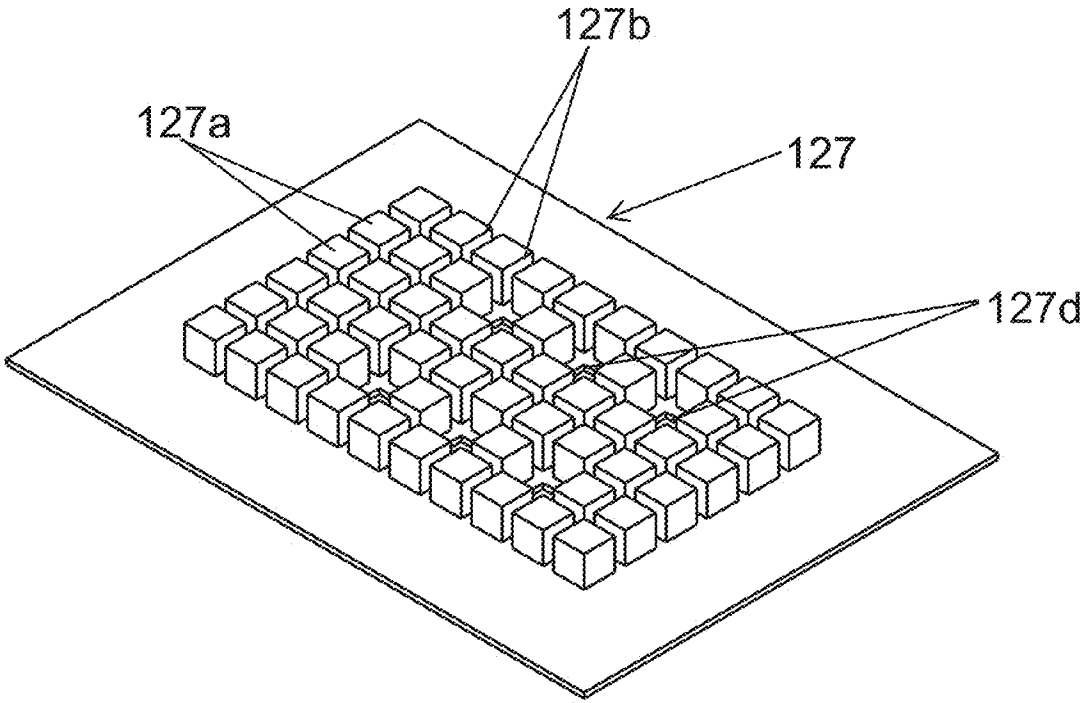
FIG. 17 is a bottom perspective view of a component of the gel-based cushioning assembly of FIG. 15.

As best seen in FIG. 16, gel-based cushioning assembly 126 includes a dry polymer gel layer or core 140, a base sheet 142, and an upper sheet 144, which are adhered to the respective upper and lower surfaces of gel layer 140 to provide an anchorage system for the gel layer. For example, sheets 142 and 144 are formed from a non-woven, such as 6/6 nylon. Gel layer 140 may be formed from a number of suitable gels, such as described below, and a number of different gel configurations, including the buckling column configurations described in the referenced patents. For example, in the illustrated embodiment, gel layer 140 is formed in a matrix similar to gel layer 144 but instead may have a gel wall thickness in a range of 1/32 to 3/8 inches, optionally in a range of 1/16 to 1/4 inches, and optionally approximately 0.187 inch. Again, each of the passageways may be circular, rectangular, or rounded squares and have a transverse dimension or width (or radius) in a range of 1.5 to 2.5 inches, optionally in a range of 1.75 to 2.25 inches, and optionally approximately 2 inches. Further, the depth of the passageways may be approximately equal or greater to their width for example in a range of 1.5 to 3.0 inches, in a range of 1.75 to 2.75 inches, and optionally approximately 2.1 inches. Thus, gel layer 140 is significantly softer than gel layer 114.

So as to not interfere with the compression or envelopment characteristics of gel core 140, the base and top layers each have a central opening 142*a* and 144*a*, respectively, and are each secured to the gel layer around the gel layer's perimeter, for example by welding, such as described in the referenced patents and co-pending applications noted below. To modify the buckling characteristics of gel layer 140, assembly 126 further includes a matrix of foam bodies, such as blocks, which insert into the transverse passageways or hollow spaces 140*a* between the gel walls 140*b*, which provide the cushioning support to the patient. The foam is optionally a relatively soft foam with an IFD, for example, in a range of 5 to 20, 10 to 18, and optionally about 15. In this manner, when a patient immerses into gel assembly 126, the patient's protruberances will initially encounter the gel layer which is very soft and will buckle. As the gel walls collapse, while the overall patient mass will be immersed throughout because of the soft faom, the patient's protruberances will then also encounter the foam, which together with the gel will slow the immersion to provide a more gradual immersion into the surface.

Figure 19:
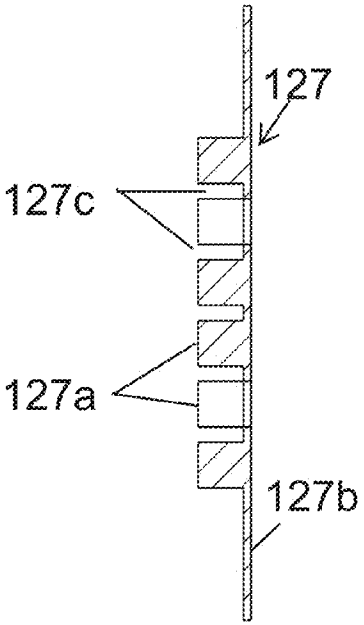
FIG. 19 is an end view of the component of FIG. 17.
Figure 18:
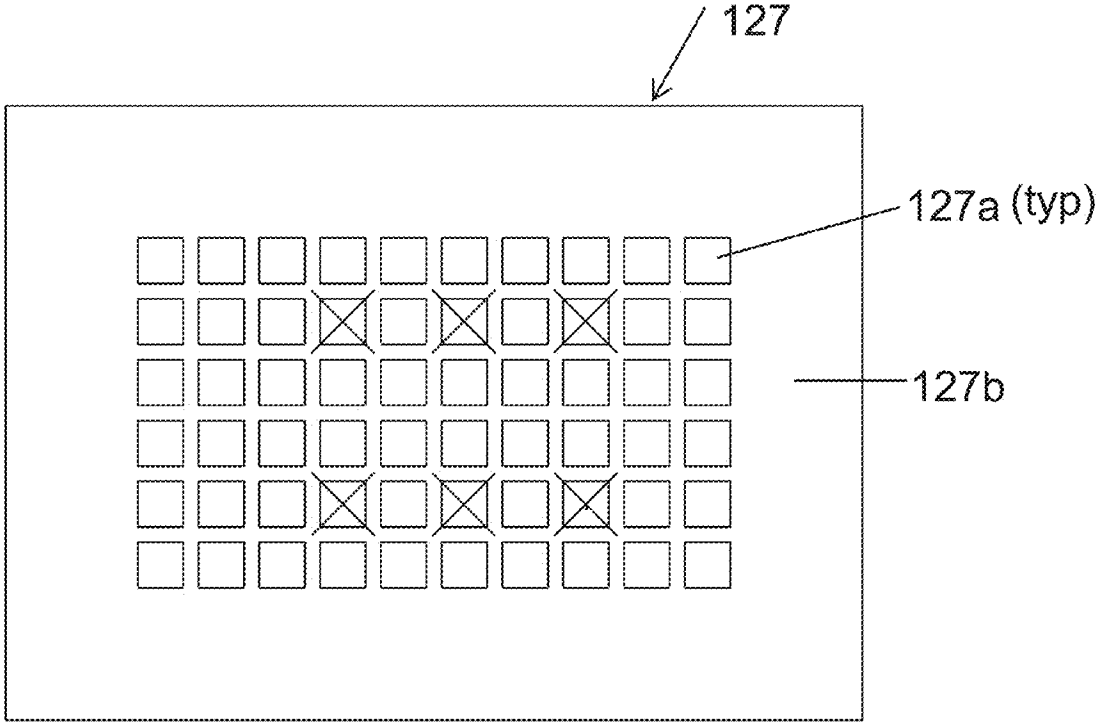
FIG. 18 is a top plan view of the component of FIG. 17.

Referring to FIGS. 18 and 19, the foam bodies may be provided on or by a foam sheet 127. Sheet 127 includes a plurality of projecting foam blocks 127*a*, which extend upwardly from sheet 127 and are centrally located and inwardly spaced to leave a flange 127*b* for mounting sheet 127 in gel assembly 126. Each block 127*a* is spaced from an adjacent block a distance 127*c* that is greater than the width of each gel wall 140*b* so that when sheet 127 is aligned under gel assembly 126, gel blocks 127*a* may be aligned and then inserted into the respective passageways 140*a* of gel layer 140. Foam blocks 127*a* may be generally cube in shape and, therefore, only partially extend into each passageway 140*a*. In this manner, when a load is placed on gel layer 140, gel walls 140*b* will initially start to buckle but after reaching a certain depth will be supported by foam blocks 127*a* so that the buckling is more controlled and in effect broken down into several stages over the full range of immersion into the support. In addition, again to assist with the air flow through support 110, foam sheet 127 optionally includes a plurality of transverse passageways or openings 127*d*.

The foam bodies may be located in all of the passageways or in just a few, to leave some passageways unblocked and unimpeded for air flow through gel layer 140 as will be more fully described below. Although illustrated as a solid body, namely a solid block, gel bodies may also be hollow or have a cross-section, for example a "T" cross-section, which permits air flow either through the foam bodies themselves (i.e. in the case of a hollow foam body) or may form a space between the foam body and the adjacent gel wall or walls.

Thus, when foam sheet 127 is properly aligned with gel layer 140, foam sheet 127 may be secured to the lower non-woven sheet, for example by welding an adhesive. Thus when assembled, each of the base and top layers 142, 144 can then be anchored to the adjacent or upper foam layers using an adhesive. Therefore, base and top layers 142 and 144 anchor and secure the gel core 140 and foam sheet 127 to the other layers but without impeding or hampering the immersion and buckling characteristics of the gel walls of the core layer. Further, the middle section of the gel core may be free of any sheets or other layers, such as non-woven sheets, overlying the gel, which would otherwise interfere with patient's immersion into the surface. For example, the surface does not have any intermediate layers of non-woven material that span any significant portion of the gel layer without any breaks in the sheet (e.g. openings), which could otherwise create a hammocking effect and hamper immersion.

In addition to non-woven layers 142 and 144, gel-based cushioning assembly 126 may optionally include one or more non-woven patches (which do not span more than one or two of the gel walls), which are welded to the upwardly facing side of gel core 140 to provide additional anchor points, for example, to anchor gel-based cushioning assembly 126 in layer 118, including to the underside of non-woven carrier or to the gel layers of upper layer 113.

Similar to gel layer 114, suitable dry polymer gels or gelatinous elastomeric materials for forming the gel core may be formed by blending an A-B-A triblock copolymer with a plasticizer oil, such as mineral oil. The "A" component in the A-B-A triblock copolymer is a crystalline polymer like polystyrene and the "B" component is an elastomer polymer like poly(ethylene-propylene) to form a SEPS polymer, a poly (ethylene-butadyene) to form a SEBS polymer, or hydrogenated poly(isoprene+butadiene) to form a SEEPS polymer. For examples of suitable dry polymer gels or gelatinous elastomeric materials, the method of making the same, and various suitable configurations for the gel layer reference is made to U.S. Pat. Nos. 3,485,787; 3,676,387; 3,827,999; 4,259,540; 4,351,913; 4,369,284; 4,618,213; 5,262,468; 5,508,334; 5,239,723; 5,475,890; 5,334,646; 5,336,708; 4,432,607; 4,492,428; 4,497,538; 4,509,821; 4,709,982; 4,716,183; 4,798,853; 4,942,270; 5,149,736; 5,331,036; 5,881,409; 5,994,450; 5,749,111; 6,026,527; 6,197,099; 6,843,873; 6,865,759; 7,060,213; 6,413,458; 7,730,566; 7,823,233; 7,827,636; 7,823,234; and 7,964,664, which are all incorporated herein by reference in their entireties.

Other formulations of gels or gelatinous elastomeric materials may also be used in addition to those identified in these patents. As one example, the gelatinous elastomeric material may be formulated with a weight ratio of oil to polymer of approximately 3.1 to 1. The polymer may be Kraton E1830 available from Kraton Polymers, which has a place of business in Houston, Tex., or it may be another suitable polymer. The oil may be mineral oil, or another suitable oil. One or more stabilizers may also be added. Additional ingredients—such as, but not limited to—dye may also be added. In another example, the gelatinous elastomeric material may be formulated with a weight ratio of oil to copolymers of approximately 2.6 to 1. The copolymers may be Septon 4055 and 4044 which are available from Kuraray America, Inc., which has a place of business in Houston, Tex., or it may be other copolymers. If Septon 4055 and 4044 are used, the weight ratio may be approximately 2.3 to 1 of Septon 4055 to Septon 4044. The oil may be mineral oil and one or more stabilizers may also be used. Additional ingredients—such as, but not limited to—dye may also be added. In addition to these two examples, as well as those disclosed in the aforementioned patents, still other formulations may be used.

As noted above, gel-based cushioning assembly 126 is located between gel layer 114 and base layer 118 and aligns generally with the sacrum area of the patient. In this manner, the sacrum area of patient support 10 has a generally soft topper formed by gel layer 114 but which decreases in firmness by way of gel-based cushioning assembly 126. Therefore, the gel assembly will initially exhibit much of the deflection, then followed by the deflection in the top layer after the effect of the foam blocks are realized. After a predetermined level of immersion into gel assembly 126, foam sheet 127 will slow the immersion to avoid a peak stress that may occur without foam layer 127 and thereby provide even further redistribution of the load from the patient to neighboring gel walls that may not otherwise be subject to compression. Thus, the pressure redistribution is achieved by isolating the sacral region mostly with gel technology but then engaging the distribution properties of surrounding gel structures in the gel core 140 by virtue of the foam inserts (foam bodies). At the same time, the patient will exhibit immersion into the gel top layer. As a result, the bottom gel layer assembly deals with the average pressure, while the top gel layer deals with peak pressure or bony protruberances or prominences.

Optionally, patient support 110 may include transitional layers between the softer layers and the more firm layers of patient support. For example, as noted above and referring to again FIG. 14 patient support 110 may optionally include a transition between foam section 124 and gel-based cushioning assembly 126 and, further, between gel cushion assembly 126 and foam wedge 128. For example, a foam insert may be provided at the interface between gel cushion assembly 126 and foam section 124 in the form of wedge-shaped foam member 148, which is less firmer than foam section 124 but firmer than gel-based cushioning assembly 126. For example, wedge-shaped foam member 148 may have an IFD in a range of 38 to 46 and a density in a range of 1.65 to 1.95 pcf. Further, with its wedge-shaped configuration, which matches the wedge-shaped edge of foam section 124, the firmness decreases along the longitudinal direction of patient support 110, increasing from the head end to the sacral region of the support.

Similarly, a second generally wedge-shaped foam member 146 may be positioned between gel-based cushioning assembly 126 and foam wedge 128. For example, member 146 may be formed from a similar material to member 148 (namely a foam having an IFD in a range of 38 to 46 with a density in a range of 1.65 to 1.95 pcf, available under the product number 1842AM-RB (Valle Foam)). Member 146 may similarly have a wedge section which is similar to member 148 so that the stiffness of the insert increases between the interface of gel-based cushioning assembly 126 and wedge 128 in the direction of the feet and, further, matches the wedge-shaped edge of wedge-shape section 128. Further, member 146 is located in the knee region of a patient and in effect forms a hinge effect at the knee region to further reduce the stress on the patient's heels. Additionally, member 146 creates a positioning pocket that helps prevent the patient from sliding down the mattress.

As noted above, at least rails 132 are formed from a foam with a greater firmness than any of the other components forming patient support 110. For example, a suitable foam forming rails 132 may have an IFD in a range of 60 to 70 with a density in a range of 1.4 to 1.5 pcf. One suitable foam is available under the Product No. 1565AM-RBR (Valle Foam). The dimensions of rails 132 may be varied but may fall in the range of 4 to 5 inches tall, in a range of 4.25 to 4.75 inches tall, and optionally approximately 3.5 inches. The width of rails 132 may fall in the range of 3 to 4 inches, optionally in a range of 3.25 to 3.75 inches, and optionally approximately 3.5 inches. As noted above, the wedge-shaped end of rails 132 generally matches the slope of wedge-shape section 128 and, therefore, similarly falls in a range of 5° to 10°, optionally in a range of 6° to 9°, optionally about 8°.

Rails 130 similarly has an increased firmness over many of the components of patient support 110 but optionally is less firm than rails 132 and may be formed from a foam with an IFD in a range of 38 to 46, and a density in a range of 1.65 to 1.95 pcf similar to members 46 and 48. For example, rails 130 may have a width approximately equal to the width of rails 132 and may have a height in a range of 1 to 2 inches, optionally in a range of 1.25 to 2.25 inches, optionally in a range of 1.5 to 2 inches, and optionally approximately 1.75 inches. Optionally, rail 132 may be slightly wider than rail 130 and may have a width in a range of about 3 to 4.5 inches, 3.25 to 4.25 inches, and optionally about 3.75 inches.

As best understood from FIG. 14, wedge member 148 may extend across the full width of the patient support surface section of patient support 110 and may have a height in a range of 3 to 4 inches, optionally in a range of 3.25 to 3.75 inches, and optionally approximately 3.5 inches. The length of member 148 may fall in a range of 5 to 9 inches, optionally in a range of 6 to 8 inches, and optionally approximately 7.5 inches. In addition, the upper surface 148 of member 148 may have a sloping face 148*b* that forms an angle in range of 35 to 55°. 40 to 50° and optionally of approximately 45°, which generally matches the slope of the wedge-shaped section or edge of foam section 124. Additionally, wedge 148 may have transverse passageways 148*d* to allow air flow through layer 118.

Wedge shaped insert 146 may have a slope in a range of about 25° to 35°, 27 to 33° and optionally about 29°. The thickness or height of insert 146 maybe in a range of 2 to 3 inches, optionally in a range of 2.25 to 2.75 inches, and optionally approximately 2.4 inches, and have a length optionally in range of 6.5 to 7.5 inches, optionally in a range of 6.75 to 7.25 inches, and optionally approximately 6.9 inches. The angled face of the wedge may be offset from the rectangular base of the trapezoid in a range of 2 to 3 inches, optionally in a range of 2.25 to 2.75 inches, and optionally approximately 2.5 inches.

Figure 23:
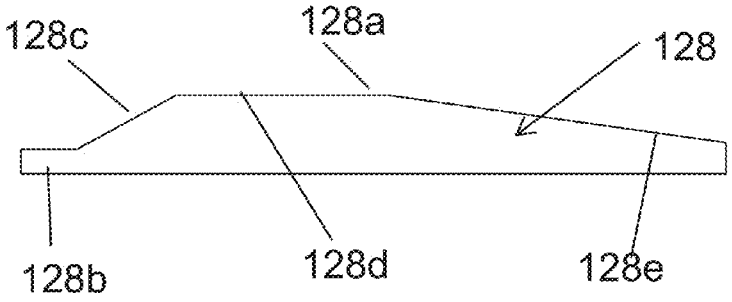
FIG. 23 is a side view of the component of FIG. 22.
Figure 24:
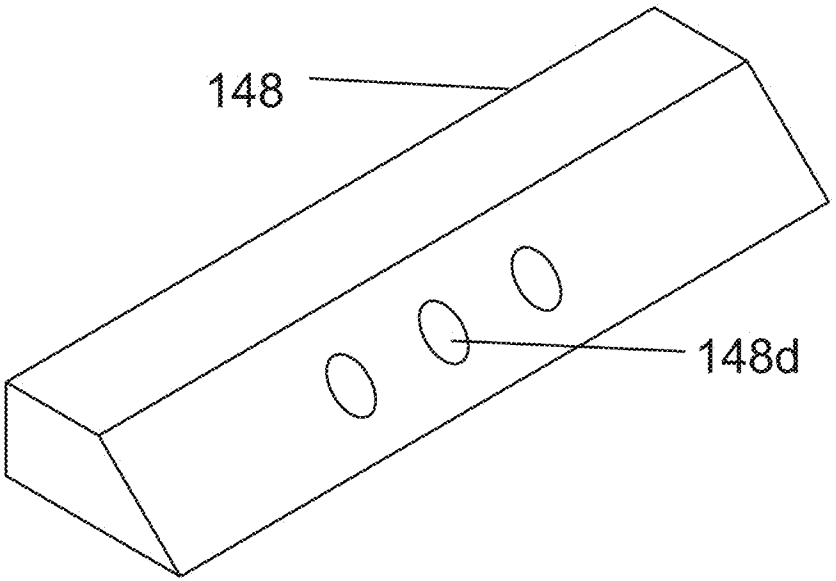
FIG. 24 is a perspective view of another component of the intermediate layer of the patient support of FIG. 12.
Figure 24A:
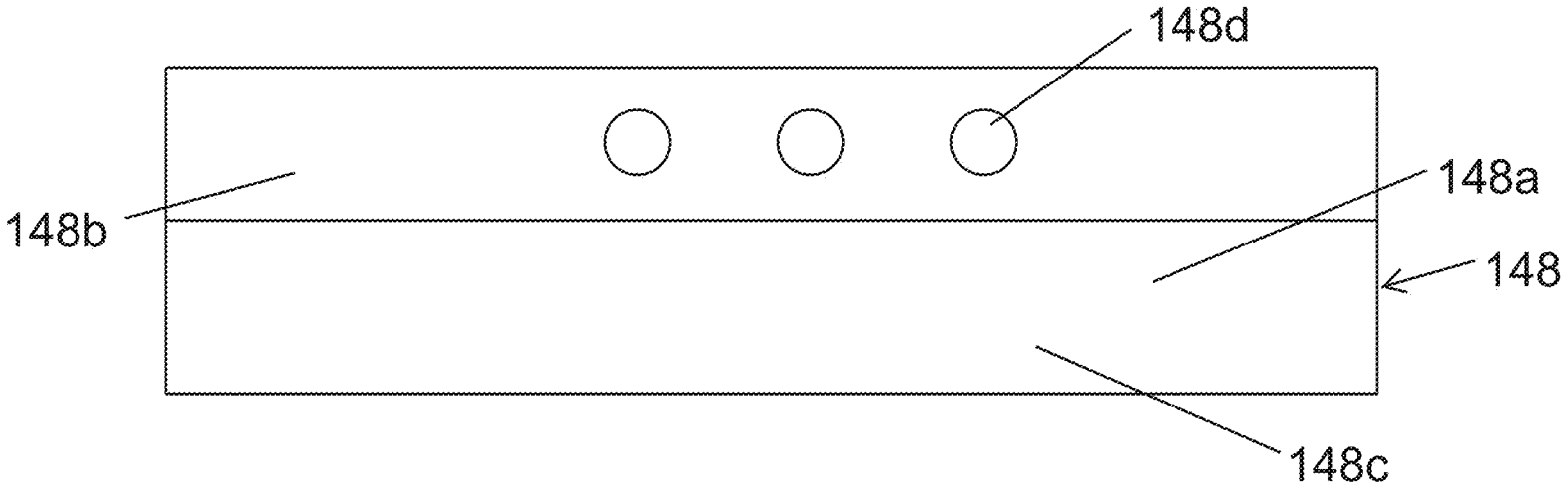
FIG. 24A is a top plan view of the component of FIG. 24.
Figure 25:
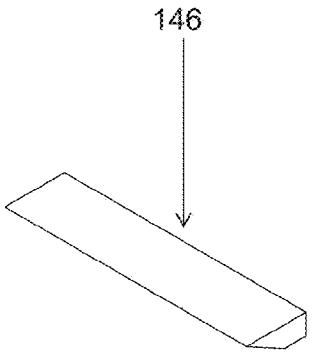
FIG. 25 is a perspective view of another component of the intermediate layer of the patient support of FIG. 12.
Figure 25A:
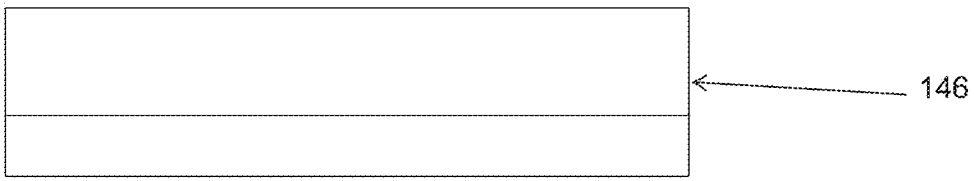
FIG. 25A is a top plan view of the component of FIG. 25.
Figure 26:
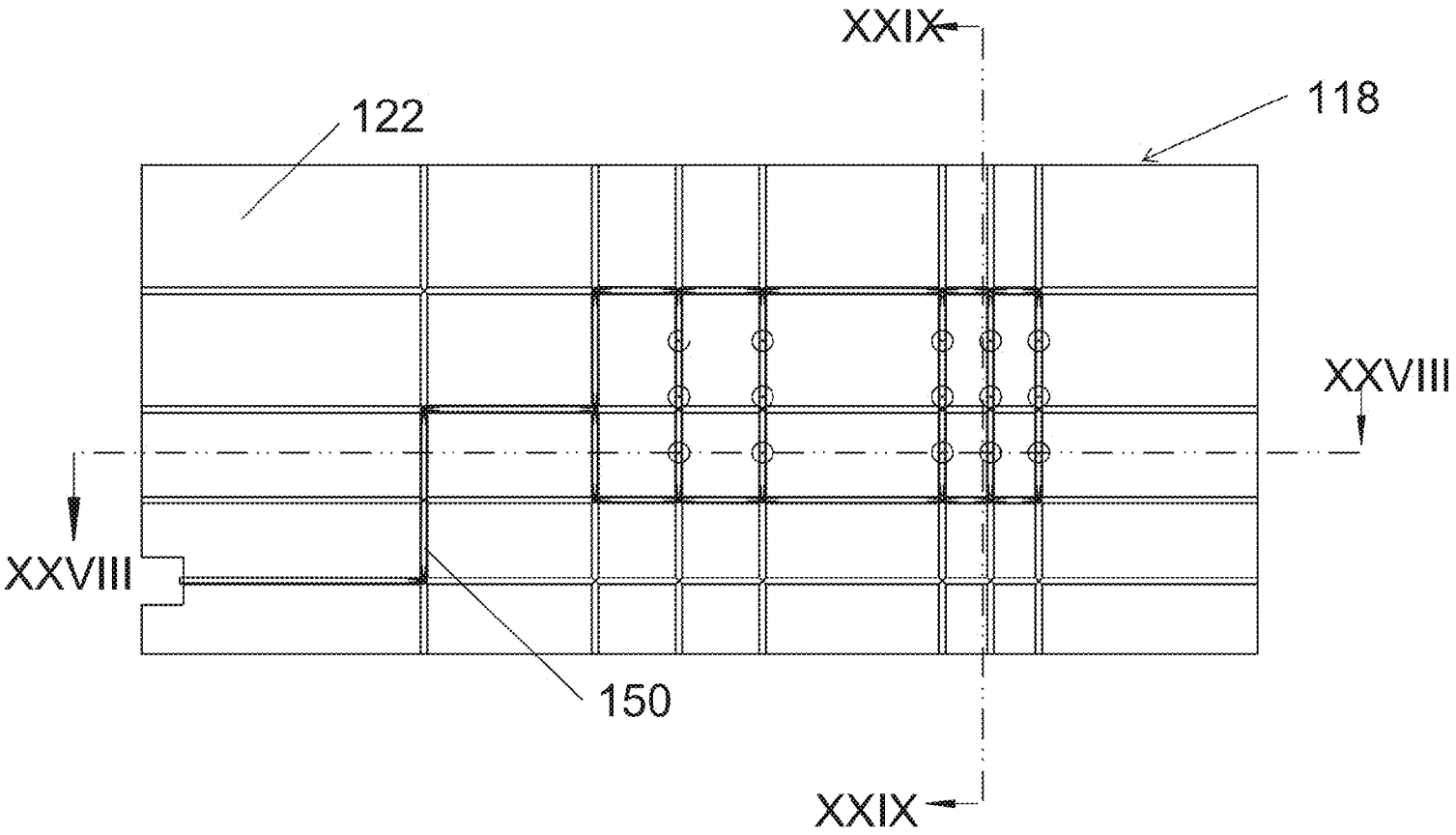
FIG. 26 is a top plan view of the base cushioning layer of the patient support of FIG. 12.

As best understood in FIG. 14, wedge 128 also optionally extends across the full width of the patient support surface formed by patient support 10. Referring to FIG. 23, wedge 128 includes an upper surface 128*a* with a step profile starting at the foot end with a ramped portion 128*e* forming an angle, as noted above in a range of about 5° to 10°, in a range of about 6° to 9°, or approximately 8.0°, and a stepped down portion 128*d*, which is generally horizontal. Adjacent the stepped portion 128*d* is a reverse sloped section 128*c*, which is angled in a range of approximately 24° to 34°, optionally in a range of about 26° to 32°, and optionally approximately 29°, and a second stepped portion 128*b* which is generally horizontal to abut gel cushioning assembly 126. In this manner, wedge-shaped member 146 is trapped by wedge 128 and gel cushion assembly 126 whose non-woven base layer is secured to the upper and lower facing surfaces of wedge section 128, using an adhesive, and is in turn adhered to wedge 128 by an adhesive. Further, as would be understood, each of the adjacent facing surfaces of each of the foam members may be glued together to form a monolithic cushion.

Once assembled and glued together, the foam layers and gel layers are then enclosed in a fire sock (not shown) and an optional antimicrobial sock (which may be included on one or more of the components, such as the foam), and thereafter cover 112 (FIGS. 1 and 33), which may be formed from a top sheet of 70 denier nylon taffeta with a rubberized coating, which is available from Stratex®, and a bottom sheet of a standard healthcare fabric available from Vintex, Inc., which are then joined together by stitching and a zipper. Alternately, as described in reference to FIG. 33, cover 112 may be formed from breathable, stretchy knit material, such as is available under the trade name Dartex.

In addition to the wedge-shaped inserts that provide transitions between the different levels of firmness, support 110 may also incorporate wedge-shaped inserts to form additional hinges to allow the support to bend at lateral axes to raise or lower the head or foot sections along the length of the support or along longitudinal axes, such as described in U.S. Pat. No. 7,441,290, to allow turning of the patient, which is commonly assigned to Stryker Corporation and which is incorporated by reference in its entirety herein.

Further, support 110 may incorporate bottom-out sensors (such as described in U.S. Pat. No. 6,943,694); tie downs; turn assist bladders, such as described in U.S. Pat. No. 8,006,333, and climate management systems (such as described in copending U.S. application Ser. No. 12/640,770, filed Dec. 17, 2009, entitled PATIENT SUPPORT; and Ser. No. 12/640,643, filed Dec. 17, 2009, entitled PATIENT SUPPORT), all of which are incorporated by reference in their entireties herein.

Accordingly, the present invention provides a mattress that can be configured as a non-powered mattress but which can provide pressure redistribution associated with all gel-based mattresses or powered surfaces and further can comfort for the patient. With the soft cushioning regions adjacent the firmer sacrum area (provided by the gel layer), the mattress allows the patient to immerse into the patient support surface and be properly aligned on the surface. In addition, as pressure is applied over time, the gel layer can maintain its structure due to its high memory and durability.

Figure 27:
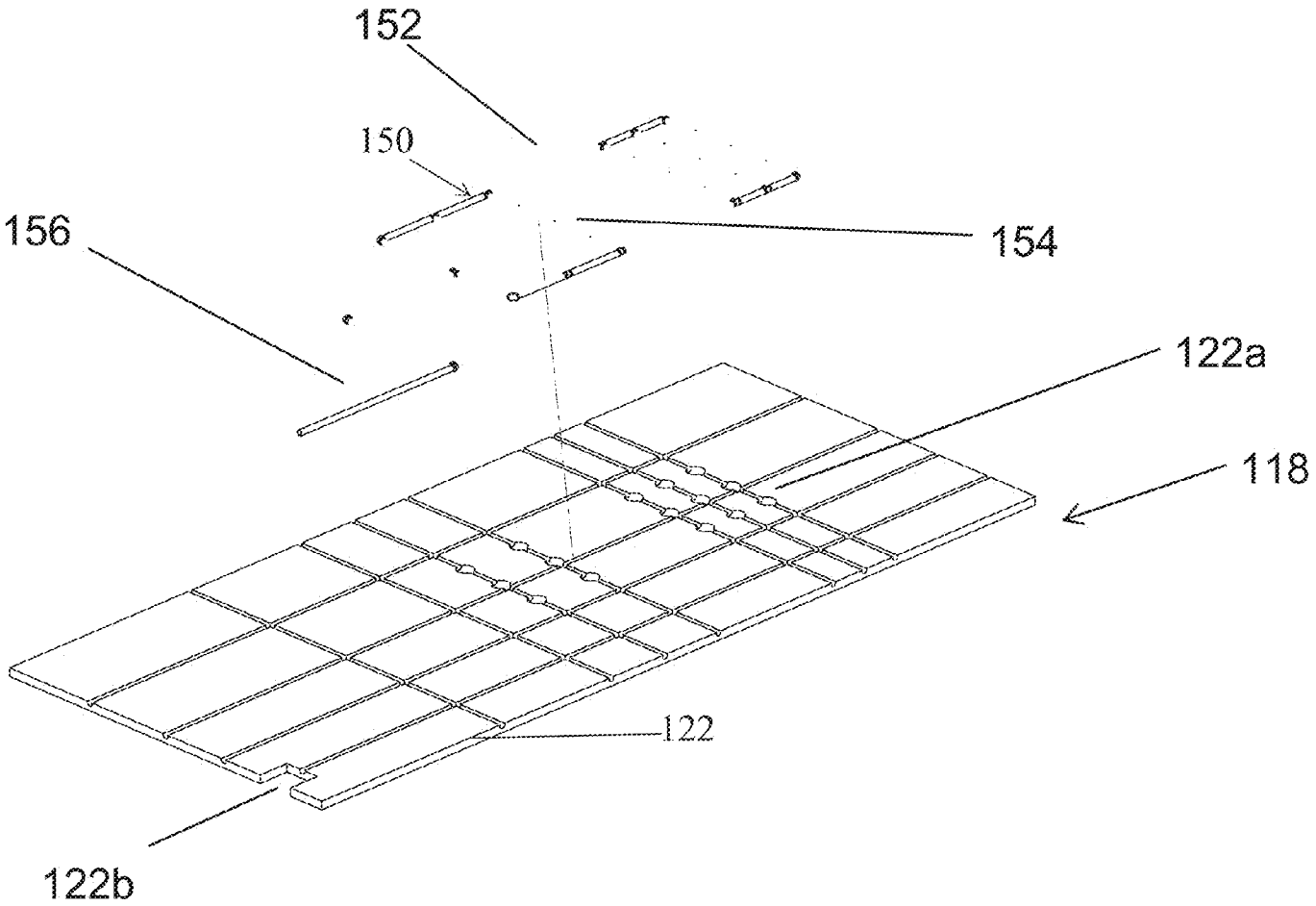
FIG. 27 is an exploded perspective view of the base cushioning layer of FIG. 26.
Figure 27A:
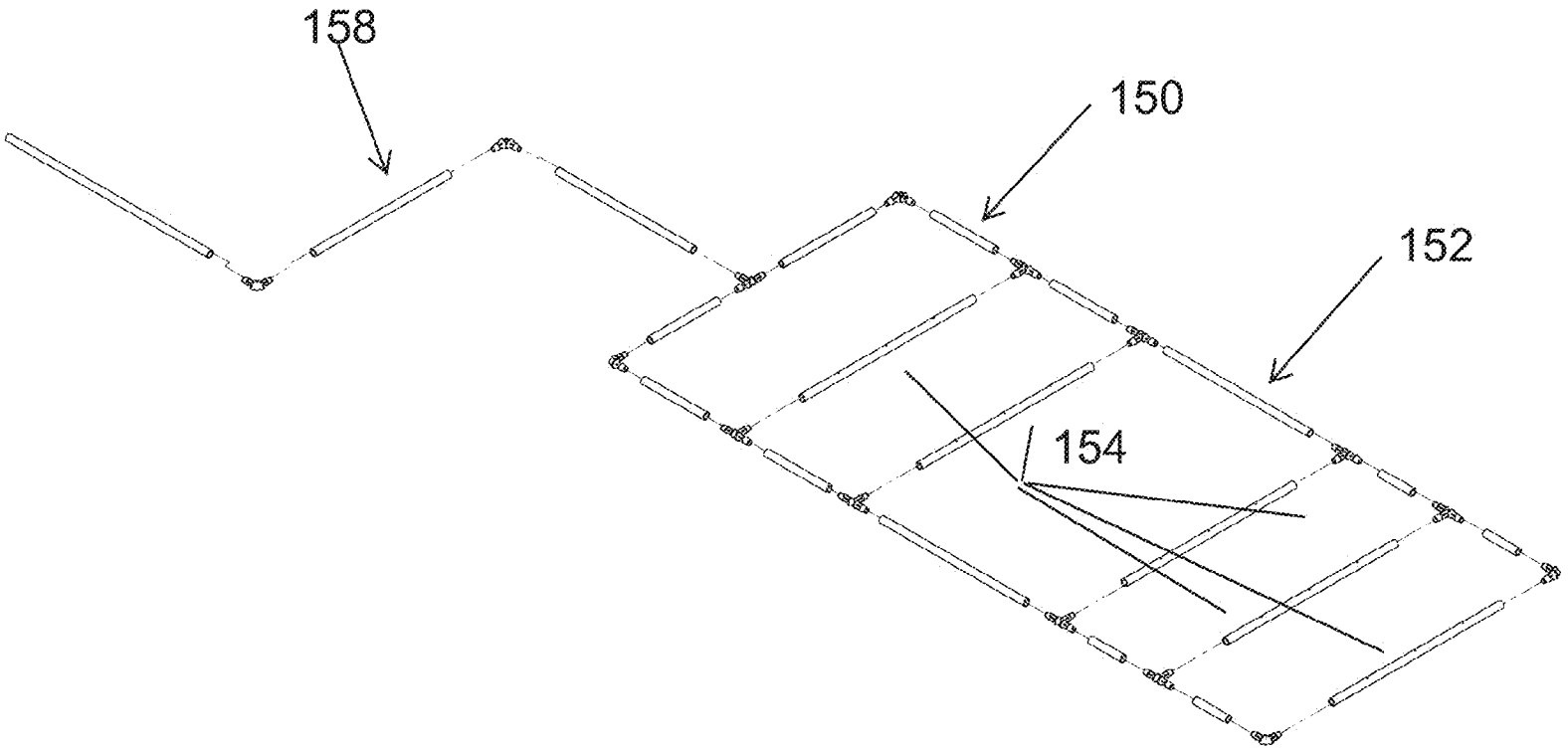
FIG. 27A is an exploded perspective view of the low air loss pneumatic circuit of the base cushioning layer of FIG. 27.
Figure 28:
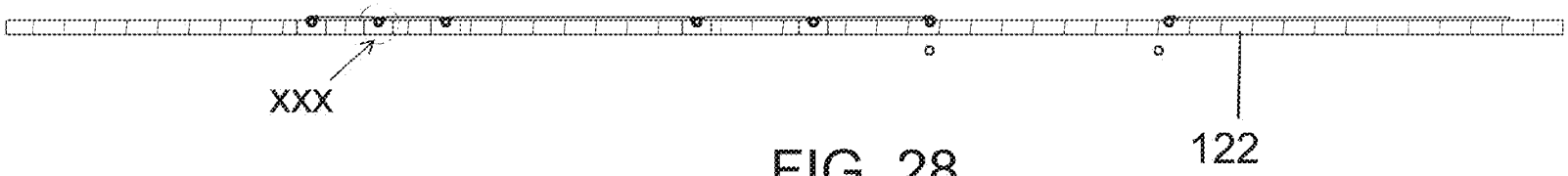
FIG. 28 is a side view of the base cushioning layer.
Figure 29:
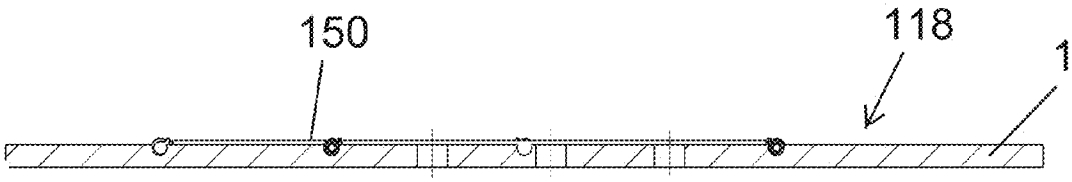
FIG. 29 is another side view of the base cushioning layer.
Figure 30:
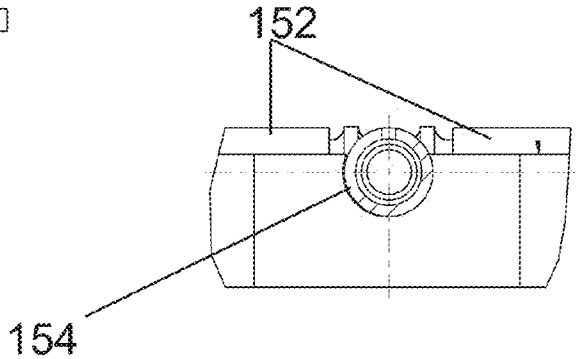
FIG. 30 is an enlarged side view of the base cushioning layer.

As noted above, support 110 may incorporate a low air loss system 150 that pushes or pulls air though one or more of the cushioning layers that make up support 110. Referring to FIG. 27, lower layer 118 includes a carrier, such as a foam sheet 122, which supports low air loss system 150 for delivering air to inside cover 112 and though one or more of the cushioning layers of support 110 through the various passageways, as noted.

Low air loss system 150 includes a pneumatic circuit 152 formed from flexible tubes or tubing, for example perforated tubes or tubing, which are arranged in a planar configuration and optimally arranged in a rectangular loop, which is in fluid communication with an inlet tube or tubing 156 for coupling to a pump either mounted internal or external to cover 112. Alternately, air outlet openings may be provided in the various fitting that connect the tubes or tubing together. To accommodate inlet tubing 156 and its connection to a blower or pump, one or more components, such as wedge 128 and foam sheet 122 may be notched (128*f*, 122*b*).

One or more transverse tubes or tubing 154 may be include in circuit 152 to interconnect opposed sides of the loop (by way of T-couplers) to provide additional sources of air flow from the central region of the loop.

To facilitate handling and assembly, circuit 152 is mounted to foam sheet, for example, in channels 122*a* formed in foam sheet 122. In this manner, foam sheet 122 acts a flexible carrier to form a flexible pneumatic manifold for delivering air to multiple locations in support 110, which directs air flow through the various gel layers to the patient interface, which helps manage the moisture in support 110.

Figure 31:
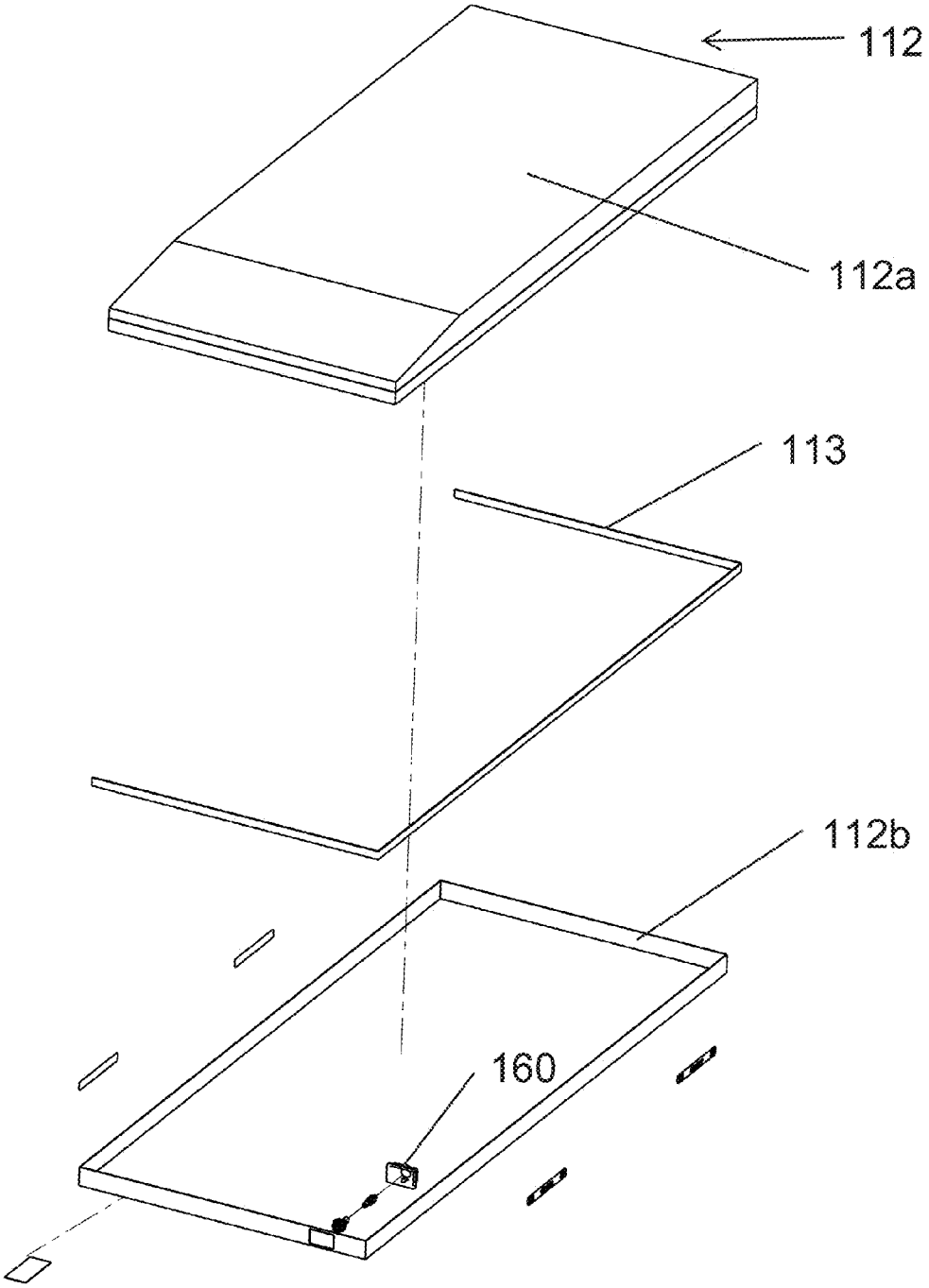
FIG. 31 is an exploded perspective view of the cover.
Figure 32:
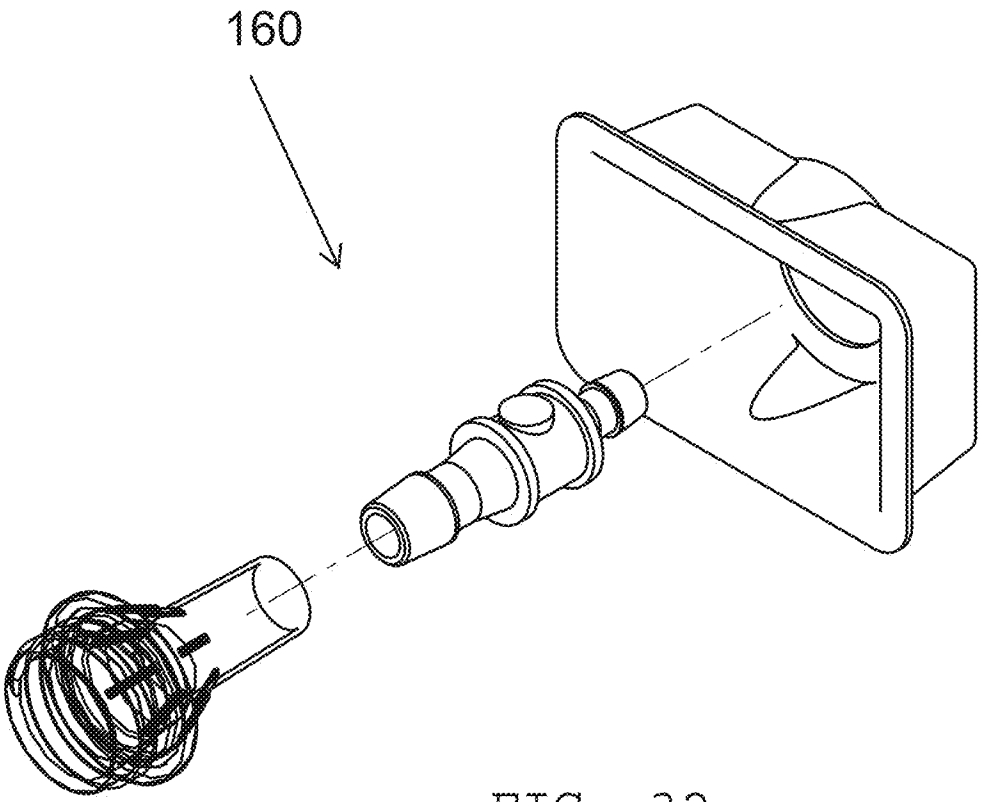
FIG. 32 is an exploded perspective view of a pneumatic coupler supported in the cover.
Figure 33:
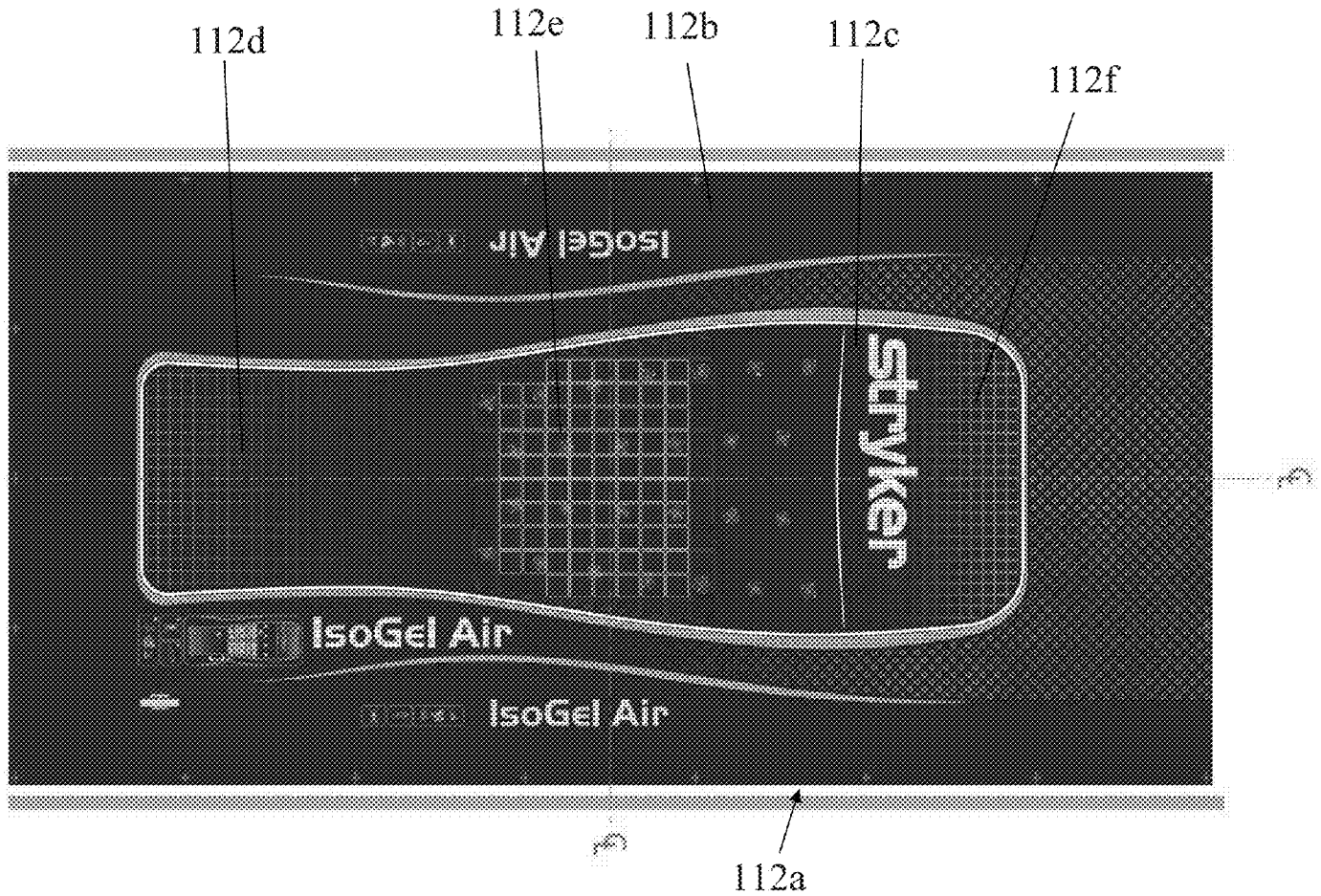
FIG. 33 is a plan view of the top sheet of the cover.

Referring to FIGS. 31 and 33, patient support cover 112 may provide a plurality of optional features. As best seen in FIG. 31, cover 112 is formed from a top sheet 112*a* and a bottom sheet 112*b*, which are joined together on one side by stitching and joined on their other three sides by a zipper 113 (FIG. 31). Bottom sheet 112*b* may support an attachment box (FIG. 32), which supports a fitting and valve 160 (FIG. 32), which mount to the end of inlet tubing 156 to enable the low air loss system 150 to couple to an air supply, such as a pump external to cover 112. As noted about the pump or a blower may be mounted inside cover.

Cover 112 may be formed from a flexible knit material, such as a flexible knit nylon or a nylon-like fabric or polyester, such as Dartex, which provides a high breathability rate to facilitate moisture management but which does not allow liquid intrusion into the cushion layers beneath cover 112. Additionally, cover 112 may be formed with the knit fibers on the patient facing side of the cover and with an inner surface formed by a stretchy elastomeric membrane that is stretchable so as not to reduce, if not eliminate, any interference with the patient immersion into support 110, as will be more fully described below. Furthermore, as will be more full described below, because cover 112 optionally encloses one or more blowers or fans for circulating air through the support, as part of a low air loss system, cover 112 may incorporate an open mesh panel to allow air to be drawn into the cover 112.

In another aspect, cover 112 may include one or more indicia on its surface. For example, cover 112 may include on its top sheet 112*b* indicia to define the preferred location for a patient on patient support 110 and may include indicia to provide instructions to the caregiver, for example. The indicia may include a demarcation 112*c*, such as a line, that defines the overall general area in which the patient should be positioned in the supine position and additional demarcations 112*d*, 112*e*, 112*f*, also for example lines, that define the foot area, the thigh and seat area, the back area, and the head area of the patient support. In this manner, when a patient is located in the general area and also generally aligned with the sub-areas, the patient will be properly aligned with the support cushioning layers and turning bladders that are configured to provide the appropriate cushioning and functionality to that region of the patient's body.

In addition to the demarcation lines that identify the different areas/sections of the support, other indicia may be applied for example, graphical instructions, representations of the underlying cushioning layers (e.g. the gel or bladders), as well as the location of optional percussion/vibration and/or turning bladders to again facilitate the proper positioning of the patient.

The various demarcations, which for example indicate the different areas of support, i.e. thigh and back support areas, foot support areas, and head support areas, may be applied to the underlying sheet that forms the cover using a heat transfer process. For example, ink that is applied to a carrier sheet may be transferred onto the fabric that forms the cover using heat. In this manner, the ink does not simply coat the fabric, as is the case with silk screening, and instead merges with the fabric (and optionally underlying elastomeric membrane) which provides the sheet with generally constant properties. This tends to reduce the wear and provide increased longevity to the demarcations.

While several forms of the invention have been shown and described, other changes and modifications will be appreciated by those skilled in the relevant art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which we claim an exclusive property right or privilege are defined as follows:

1. A patient support comprising:

a plurality of stacked layers of cushioning material joined together to form a cushion assembly, the stacked layers including an upper cushioning layer and an intermediate layer beneath the upper cushioning layer, and a lower layer beneath and joined with the intermediate layer, said upper cushioning layer and said intermediate layer together defining an immersion region into which a person sinks and is immersed;

the intermediate layer comprising a gel assembly having a gel layer, the gel layer being formed by a plurality of intersecting gel walls, the intersecting gel walls forming spaces there between to thereby form transverse passageways;

the lower layer comprising a cushioning layer with recesses and being located beneath the immersion region; and a low air loss system located in the recesses of the lower layer and located below the immersion region and beneath the gel layer, the low air loss system including tubing to couple to an air supply and to direct air flow into the gel layer through the transverse passageways formed in the gel layer, the lower layer joined with said gel assembly, and the lower layer forming a carrier to carry the tubing wherein the tubing is below the immersion region.

2. The patient support according to claim 1, wherein the lower layer comprises a foam sheet.

3. The patient support according to claim 2, wherein the intermediate layer comprises at least one foam sheet joined with the gel assembly, and the foam sheet of the intermediate layer having a different firmness than the gel layer of the gel assembly.

4. The patient support according to claim 1, wherein the intermediate layer has a lower IFD than the upper cushioning layer.

5. A patient support comprising:

a plurality of stacked layers of cushioning material joined together to form a cushion assembly, the stacked layers including an upper cushioning layer and an intermediate layer beneath the upper cushioning layer, and a lower layer beneath the intermediate layer;

the intermediate layer comprising a gel assembly having a gel layer;

the gel layer including transverse passageways; and a low air loss system located in the lower layer beneath the gel layer, the low air loss system including tubing to couple to an air supply and to direct air flow into the gel layer through the transverse passageways, the lower layer joined with said gel assembly, and the lower layer forming a carrier to carry the tubing wherein the gel layer is formed by a plurality of intersecting gel walls, the gel walls forming spaces there between to thereby form the transverse passageways, at least some of the spaces each having a foam body inserted therein, the foam bodies together with the gel layer forming the gel assembly, and the foam bodies forming cushioning surfaces at their upper end wherein when the gel walls buckle to the height of the foam bodies the foam bodies together in parallel with the gel walls which provide cushioning support to a person supported on the patient support.

6. The patient support according to claim 5, wherein the gel walls are arranged to form rectangular recesses.

7. The patient support according to claim 1, wherein the upper cushioning layer comprises a gel layer.

8. The patient support according to claim 1, wherein the intermediate layer includes a foam wedge, the foam wedge having a firmness that is different than a remaining portion or portions of the intermediate layer.

9. The patient support according to claim 8, wherein the foam wedge abuts the gel layer.

10. The patient support according to claim 1, further comprising two rails, the stacked layers of cushioning material forming a primary patient support surface bounded by the two rails, and the two rails being formed from a foam material with a greater firmness than any of the layers forming the patient support surface to thereby form a cradle around the patient support surface, wherein each rail is formed from an upper rail and a lower rail, and each lower rail having a greater firmness than its respective upper rail.

11. The patient support according to claim 1, further comprising a deck, said cushioning assembly supported on said deck.

12. The patient support according to claim 7, said gel layer of the upper cushioning layer having transverse openings to allow air from the low air loss system to pass through the gel layer of the upper cushioning layer.

13. The patient support according to claim 12, the gel layer of the upper cushioning layer overlying the gel layer of the intermediate layer.

14. The patient support according to claim 12, wherein the gel layer of the intermediate layer is formed by a plurality of intersecting gel walls, the gel walls forming spaces there between, at least some of the spaces each having a foam body inserted therein, the foam bodies forming cushioning surfaces when the gel walls buckle to the height of the foam bodies wherein the foam bodies together in parallel with the gel walls provide cushioning support to a person supported on the patient support.

15. The patient support according to claim 14, wherein the foam bodies are supported on a foam sheet located beneath the gel layer of the intermediate layer wherein the foam bodies extend up from the foam sheet into the spaces.

16. The patient support according to claim 15, wherein the foam sheet includes openings to allow air from the low air loss system through the base sheet.

17. The patient support according to claim 11, wherein the plurality of stacked layers of cushioning material form a foot end, a seat section, and a head end.

* * * * *